US009201325B2

(12) United States Patent
Sugimoto et al.

(10) Patent No.: US 9,201,325 B2
(45) Date of Patent: Dec. 1, 2015

(54) TONER CONTAINING CRYSTALLINE POLYESTER

(75) Inventors: Tsuyoshi Sugimoto, Shizuoka (JP); Osamu Uchinokura, Shizuoka (JP); Satoshi Ogawa, Nara (JP); Junichi Awamura, Shizuoka (JP); Satoshi Kojima, Shizuoka (JP); Daisuke Ito, Shizuoka (JP); Teruki Kusahara, Shizuoka (JP); Daisuke Inoue, Shizuoka (JP); Mamoru Hozumi, Miyagi (JP); Shoko Sato, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 628 days.

(21) Appl. No.: 13/086,833

(22) Filed: Apr. 14, 2011

(65) Prior Publication Data

US 2011/0262856 A1 Oct. 27, 2011

(30) Foreign Application Priority Data

Apr. 21, 2010 (JP) ..... 2010-097558
Feb. 24, 2011 (JP) ..... 2011-038132

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/08791* (2013.01); *G03G 9/08793* (2013.01); *G03G 9/08795* (2013.01); *G03G 9/08797* (2013.01)

(58) Field of Classification Search
CPC ..... G03G 9/08795; G03G 9/08797; G03G 9/08755
USPC ..... 430/109.1, 109.4
See application file for complete search history.

(56) References Cited

U.S. PATENT DOCUMENTS

| | | | | |
|---|---|---|---|---|
| 7,858,280 | B2 | 12/2010 | Sugimoto et al. | |
| 2003/0129518 | A1* | 7/2003 | Sawada et al. | 430/109.4 |
| 2004/0152813 | A1* | 8/2004 | Shirai | 524/275 |
| 2004/0157147 | A1 | 8/2004 | Shiraishi et al. | |
| 2005/0245694 | A1 | 11/2005 | Matsumura et al. | |
| 2006/0127790 | A1* | 6/2006 | Matsumura et al. | 430/109.4 |
| 2006/0204880 | A1 | 9/2006 | Mizutani et al. | |
| 2006/0292477 | A1* | 12/2006 | Daimon et al. | 430/109.4 |
| 2007/0092822 | A1* | 4/2007 | Matsumura et al. | 430/109.4 |

(Continued)

FOREIGN PATENT DOCUMENTS

| | | |
|---|---|---|
| JP | 2624639 | 4/1997 |
| JP | 2003-167384 | 6/2003 |

(Continued)

OTHER PUBLICATIONS

U.S. Appl. No. 13/025,277, filed Feb. 11, 2011, Sugimoto, et al.

(Continued)

*Primary Examiner* — Hoa V Le
(74) *Attorney, Agent, or Firm* — Oblon, McCelland, Maier & Neustadt, L.L.P.

(57) ABSTRACT

A toner including a binder resin which contains a crystalline polyester resin and a non-crystalline polyester resin, wherein the crystalline polyester resin has at least two diffraction peaks in a range of 20°<2θ<25° as detected by X-ray diffraction measurement, and has a melting point which is 60° C. or higher but lower than 80° C., and wherein the diffraction peaks each have a half width which is less than 1.0°.

17 Claims, 1 Drawing Sheet

(56) References Cited

U.S. PATENT DOCUMENTS

| | | | | |
|---|---|---|---|---|
| 2007/0141503 | A1* | 6/2007 | Matsuoka et al. | 430/114 |
| 2007/0218396 | A1* | 9/2007 | Tomita | 430/123.52 |
| 2008/0096119 | A1* | 4/2008 | Yamamoto et al. | 430/109.4 |
| 2008/0187854 | A1 | 8/2008 | Yoshida et al. | |
| 2010/0015544 | A1* | 1/2010 | Agur et al. | 430/108.23 |
| 2010/0248123 | A1* | 9/2010 | Iwanaga et al. | 430/109.4 |
| 2010/0310980 | A1 | 12/2010 | Sugimoto et al. | |
| 2011/0065034 | A1* | 3/2011 | Arima et al. | 430/105 |
| 2011/0076612 | A1 | 3/2011 | Awamura et al. | |
| 2011/0223532 | A1* | 9/2011 | Sugimoto et al. | 430/109.4 |

FOREIGN PATENT DOCUMENTS

| | | |
|---|---|---|
| JP | 2004-245887 | 9/2004 |
| JP | 2004-264803 | 9/2004 |
| JP | 2005-15589 | 1/2005 |
| JP | 2005-62510 | 3/2005 |
| JP | 2005-189808 | 7/2005 |
| JP | 2005-338814 | 12/2005 |
| JP | 2006-18018 | 1/2006 |
| JP | 2006-113473 | 4/2006 |
| JP | 2006-138919 | 6/2006 |
| JP | 2008-191260 | 8/2006 |
| JP | 2006-251564 | 9/2006 |
| JP | 2007-286144 | 11/2007 |
| JP | 2008-233175 | 10/2008 |
| JP | 2009-128652 | 6/2009 |

OTHER PUBLICATIONS

Extended European Search Report issued Jun. 24, 2011, in Patent Application No. 11163269.1.

Information Offer Form in corresponding Japanese Patent Application No. 2011-38132 dated Jun. 19, 2014 (with English language translation).

Office Action in corresponding Japanese Patent Application No. 2011-38132 dated Sep. 4, 2014.

* cited by examiner

TONER CONTAINING CRYSTALLINE POLYESTER

BACKGROUND OF THE INVENTION

1. Field of the Invention

The present invention relates to a toner and a developer, especially to a toner to which a crystalline polyester resin is added, which is excellent in fixing ability and which forms high-quality images, and to a developer containing the toner.

2. Description of the Related Art

In recent years, demand has arisen on the market for toners having various advantageous properties such as small particle diameters for forming high-quality output images and improved low-temperature fixing ability for energy saving.

Toners obtained by the conventional kneading-pulverizing method are not easily made to have a small particle diameter. In addition, their shape is amorphous and their particle size distribution is broad. Furthermore, these toners have various problems such as requiring a large amount of energy for being fixed.

In particular, when toner materials including wax (releasing agent) for improving fixing ability are used to produce a toner by the kneading-pulverizing method, cracks occur at the interfaces of the wax during pulverization, resulting in that the wax exists on the toner surface in a large amount. As a result, although the releasing effects can be obtained, toner adhesion to a carrier, a photoconductor and a blade is likely to occur. The properties of such toners are not satisfactory in total.

In order to overcome the above-described problems the kneading-pulverizing method has, there is proposed a method for producing a toner by the polymerization method.

According to the polymerization method, toners are made easily to have a small particle diameter. Their particle size distribution is sharper than that of the toners obtained by the pulverizing method. Furthermore, the wax can be embedded in the toner particles.

As one exemplary polymerization method, Japanese Patent Application Laid-Open (JP-A) No. 11-133665 discloses a production method for a toner having a practical sphericity of 0.90 to 1.00, using, as a binder, an elongated product of a urethane-modified polyester for the purposes of improving the fluidity, low-temperature fixing ability and hot offset resistance of toner.

Also, JP-A Nos. 2002-287400 and 2002-351143 and other patent literatures disclose a production method for a toner having excellent fluidity and transferability as powder with a small particle diameter as well as being excellent in heat resistant storage stability, low-temperature fixing ability and hot offset resistance.

Japanese Patent (JP-B) No. 2579150 and JP-A No. 2001-158819 disclose a toner production method including an aging step for producing a toner binder having a more uniform molecular weight distribution and for attaining both desired low-temperature fixing ability and desired offset resistance.

Moreover, there is disclosed a method in which a crystalline polyester is used in the polymerization method for improving low-temperature fixing ability. JP-A No. 08-176310 and other patent literatures disclose a preparation method for a dispersion liquid of a crystalline polyester using a solvent for phase separation. This method can prepare a dispersion liquid whose dispersoids have a particle diameter of several tens micrometers to several hundreds micrometers, but cannot prepare a dispersion liquid whose dispersoids have a volume average particle diameter of 1.0 μm or less applicable to a toner. Furthermore, JP-A No. 2005-15589 discloses an attempt to make smaller the dispersion diameter of a crystalline polyester by mixing the crystalline polyester only with a solvent and by increasing and decreasing the temperature of the mixture. However, the particle diameter of the crystalline polyester obtained by this method is not uniform nor satisfactorily small.

BRIEF SUMMARY OF THE INVENTION

The toner production methods disclosed in JP-A Nos. 11-133665, 2002-287400 and 2002-351143 each include a step of allowing an isocyanate group-containing polyester prepolymer to undergo polymerization addition reaction with an amine in the reaction system containing an organic solvent and an aqueous medium to increase the molecular weight.

However, the toner obtained by the above-described method is increased in hot offset resistance but decreased in glossiness after fixing. Also, this method causes degradation of low-temperature fixing ability of the formed toner, and thus is still not satisfactory.

The toner production methods disclosed in JP-B No. 2579150 and JP-A No. 2001-158819 are easily applicable to condensation polymerization reaction which is performed at a high temperature. But, they are not applicable to the above-described reaction system, which contains an organic solvent and an aqueous medium, without conducting extensive studies on suitable conditions.

The toner production methods disclosed in JP-A Nos. 08-176310 and 2005-15589 each include using a crystalline polyester in the polymerization method for improving low-temperature fixing ability, as described above. These methods, however, cannot stably prepare a dispersion liquid whose dispersoids has a small particle diameter, leading to degradation of the particle size distribution of the resultant toner. In addition, exposure of the crystalline polyester to the toner surface causes filming, and thus they are not satisfactory.

The present invention aims to solve the above existing problems and achieve the following objects. Specifically, in view of the problems the above-described prior arts have, an object of the present invention is to provide a toner involving no filming and exhibiting stable low-temperature fixing ability, hot offset resistance and heat resistant storage stability; and a developer containing the toner.

The present inventors conducted extensive studies to solve the above existing problems. As a result, they have found that the object can be achieved by the below-described invention and have made the present invention.

The present invention is based on the above finding obtained by the present inventors. Means for solving the above problems are as follows.

<1> A toner including:

a binder resin which contains a crystalline polyester resin and a non-crystalline polyester resin, wherein the crystalline polyester resin has at least two diffraction peaks in a range of $20° < 2\theta < 25°$ as detected by X-ray diffraction measurement, and has a melting point which is 60° C. or higher but lower than 80° C., and wherein the diffraction peaks each have a half width which is less than 1.0°.

<2> The toner according to <1>, wherein the diffraction peaks each have a half width which is less than 0.6°

<3> The toner according to <1> or <2>, wherein the crystalline polyester resin has a melting point which is 65° C. or higher but lower than 75° C.

<4> The toner according to any one of <1> to <3>, wherein the toner has a glass transition temperature Tg1st which is 45°

C. or higher but lower than 65° C., where the glass transition temperature Tg1st is measured at the first temperature raising in DSC.

<5> The toner according to any one of <1> to <4>, wherein the toner has a glass transition temperature Tg2nd which is 20° C. or higher but lower than 40° C., where the glass transition temperature Tg2nd is measured at the second temperature raising in DSC.

<6> The toner according to any one of <1> to <5>, wherein soluble matter of the crystalline polyester resin in orthodichlorobenzene has a weight average molecular weight Mw of 3,000 to 30,000, a number average molecular weight Mn of 1,000 to 10,000, and a Mw/Mn of 1 to 10, as measured through GPC.

<7> The toner according to <6>, wherein the soluble matter of the crystalline polyester resin in the orthodichlorobenzene has a weight average molecular weight Mw of 5,000 to 15,000, a number average molecular weight Mn of 2,000 to 10,000, and a Mw/Mn of 1 to 5, as measured through GPC.

<8> The toner according to any one of <1> to <7>, wherein the toner is obtained by dispersing, in an aqueous medium, an oil phase containing an organic solvent and the binder resin in the organic solvent, so as to prepare a dispersion liquid, and by removing the organic solvent from the dispersion liquid.

<9> The toner according to <8>, wherein the crystalline polyester resin has a dissolvability to the organic solvent at 20° C. which is less than 3.0 parts by mass.

<10> The toner according to <8> or <9>, wherein the crystalline polyester resin has a dissolvability to the organic solvent at 70° C. which is equal to or more than 10.0 parts by mass.

<11> The toner according to any one of <8> to <10>, wherein the oil phase further contains a binder resin precursor as the binder resin.

<12> The toner according to any one of <8> to <10>, wherein the binder resin contains a binder resin precursor formed of a modified polyester resin, the oil phase contains a colorant and a releasing agent, and the aqueous medium contains a dispersing agent, and wherein the toner is obtained by dissolving, in the oil phase, a compound capable of being crosslinked, elongated or both crosslinked and elongated with the binder resin precursor; dispersing the oil phase in the aqueous medium to prepare a dispersion liquid; allowing the binder resin precursor to undergo at least one of crosslinking reaction and elongation reaction with the compound in the dispersion liquid; and removing the organic solvent from the dispersion liquid.

<13> The toner according to <11>, wherein the binder resin contains the binder resin precursor formed of a modified polyester resin, the oil phase contains a colorant and a releasing agent, and the aqueous medium contains a dispersing agent, and wherein the toner is obtained by dissolving, in the oil phase, a compound capable of being crosslinked, elongated or both crosslinked and elongated with the binder resin precursor; dispersing the oil phase in the aqueous medium to prepare a dispersion liquid; allowing the binder resin precursor to undergo at least one of crosslinking reaction and elongation reaction with the compound in the dispersion liquid; and removing the organic solvent from the dispersion liquid.

<14> A developer including:

the toner according to any one of <1> to <13>.

The present invention can provide a toner having excellent low-temperature fixing ability, good hot offset resistance, involving no contamination of a fixing apparatus and image, and capable of forming high-quality images with good image sharpness for a long period of time; and a developer containing the toner.

DETAILED DESCRIPTION OF THE INVENTION

Toner

Figure 1:
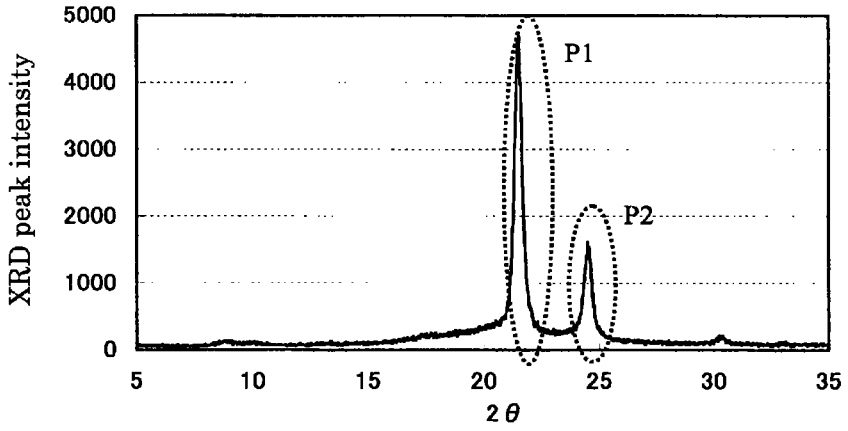
FIG. 1 is a graph showing one exemplary X-ray diffraction spectrum of a crystalline polyester resin contained in a toner of the present invention.

A toner of the present invention contains a binder resin which contains a crystalline polyester resin and a non-crystalline polyester resin, where the crystalline polyester resin has at least two diffraction peaks in a range of $20° < 2\theta < 25°$ as detected by X-ray diffraction measurement, and has a melting point which is 60° C. or higher but lower than 80° C., and where the diffraction peaks each have a half width which is less than 1.0°. The toner of the present invention is preferably produced by dispersing, in an aqueous medium, an oil phase containing an organic solvent and the binder resin in the organic solvent, so as to prepare a dispersion liquid, and removing the organic solvent from the dispersion liquid.

The crystalline polyester resin contained in the toner of the present invention has an X-ray diffraction peak whose half width is very small and has high crystallinity. Thus, the crystalline polyester resin is rapidly melted in the vicinity of its melting point, exhibiting excellent low-temperature fixing ability.

Next, the toner of the present invention will next be described in more detail.

Regarding the toner of the present invention, first, description will be given to preferable materials of the toner, preferable materials used for producing the toner, and their preferable physical properties and production methods, referring to their specific examples. Then, the measurement methods for the above physical properties will be described.

Notably, the below-described embodiments are preferable embodiments of the present invention to which technically preferable limitations are imposed. The scope of the present invention should not be construed as being limited to these preferable embodiments, unless reference is made to limitation to the present invention.

<<Organic Solvent>>

The organic solvent is preferably a solvent that completely dissolves the crystalline polyester resin at high temperatures to form a homogeneous solution but that is phase-separated from the crystalline polyester resin at low temperatures to form an inhomogeneous solution. In other words, at high temperatures, the organic solvent completely dissolves the crystalline polyester resin to form a solution. At low temperatures, at least part of the crystalline polyester resin is precipitated from the solution, to thereby form a solid-liquid mixture.

Specific examples thereof include toluene, ethyl acetate, butyl acetate, methyl ethyl ketone and methyl isobutyl ketone. These may be used alone or in combination.

(Effects of Crystalline Polyester Resin)

The crystalline polyester resin contained in the toner of the present invention has high crystallinity and thus exhibits such a hot melt property that the viscosity is rapidly decreased in the vicinity of a temperature at which fixing is initiated. That is, the present inventors have found that use of this crystalline polyester resin provides a toner having both a good heat resistant storage stability and a good low-temperature fixing ability, since the crystalline polyester resin exhibits a good heat resistant storage stability due to its crystallinity immediately before melting is initiated and is rapidly decreased in viscosity (sharp melt property) for fixing at a temperature at which melting is initiated. In addition, the present inventors have found that the toner containing this crystalline polyester resin has a suitable difference between the lower limit of the fixing temperature and the temperature at which hot offset occurs (i.e., a release range).

<Crystalline Polyester Resin>

The crystalline polyester resin is preferably a crystalline polyester resin which is obtained by synthesizing an alcohol component, such as saturated aliphatic diol compounds having 2 to 12 carbon atoms, particularly 1,4-butanediol, 1,6-hexanediol, 1,8-octanediol, 1,10-decanediol, 1,12-dodecanediol and derivatives thereof; and an acid component, such as a dicarboxylic acid having 2 to 12 carbon atoms and a double bond (C═C double bond), or saturated dicarboxylic acids having 2 to 12 carbon atoms, particularly, fumaric acid, 1,4-butanediacid, 1,6-hexanediacid, 1,8-ocatnediacid, 1,10-decanediacid, 1,12-dodecanediacid and derivatives thereof.

In particular, the crystalline polyester resin is preferably synthesized with one alcohol component selected from 1,4-butanediol, 1,6-hexanediol, 1,8-octanediol, 1,10-decanediol, 1,12-dodecanediol; and one dicarboxylic acid selected from fumaric acid, 1,4-butanediacid, 1,6-hexanediacid, 1,8-ocatnediacid, 1,10-decanediacid and 1,12-dodecanediacid, since the obtained crystalline polyester resin has a peak of a small half width and also has high crystallinity.

The crystallinity and the softening point of the crystalline polyester resin may be controlled, for example, by designing and employing a nonlinear polyester produced by condensation polymerization using an alcohol component to which, further, a trihydric or higher polyhydric alcohol such as glycerin is added and an acid component to which, further, a trivalent or higher polycarboxylic acid such as trimellitic anhydride is added during the synthesis of the polyester.

The molecular structure of the crystalline polyester resin in the present invention may be confirmed, for example, by NMR measurement of the crystalline polyester resin in a solution or as a solid, as well as by measurement of the crystalline polyester resin using X-ray diffraction, GC/MS, LC/MS, and IR. For example, simply in the infrared absorption spectrum, the crystalline polyester resin having an absorption at wavelengths of 965 $cm^{-1}$±10 $cm^{-1}$ and 990 $cm^{-1}$±10 $cm^{-1}$, which is based on an out-of-plane bending vibration (δCH) of an olefin, is exemplified.

The half width of each X-ray diffraction peak of the crystalline polyester resin is preferably less than 1.0°, more preferably less than 0.6°. When the half width of the peak is 1.0° or more, the crystalline polyester resin has low crystallinity and thus poor sharp melt property, resulting in that satisfactory low-temperature fixing ability cannot be obtained.

The dissolvability at 70° C. of the crystalline polyester resin in the organic solvent is preferably 10 parts by mass or higher per 100 parts by mass of the organic solvent. When the above dissolvability is lower than 10 parts by mass, it is difficult for the crystalline polyester resin to be dispersed in the organic solvent up to submicron size, since compatibility is poor between the organic solvent and the crystalline polyester resin. As a result, the crystalline polyester resin ununiformly exists in the toner, potentially causing degradation of chargeability and images obtained after long-term use.

The dissolvability at 20° C. of the crystalline polyester resin in the organic solvent is preferably lower than 3.0 parts by mass per 100 parts by mass of the organic solvent. When the above dissolvability is 3.0 parts by mass or higher, the crystalline polyester resin dissolved in the organic solvent tends to mix with the non-crystalline polyester resin before heating, potentially causing degradation of heat resistant storage stability, contamination of a developing apparatuses, and degradation of the formed image.

In view of the fact that a crystalline polyester resin having a sharp molecular weight distribution and having a low molecular weight is excellent in achieving low-temperature fixing ability, and that the crystalline polyester resin containing a large amount of the component having a low molecular weight is poor in heat resistant storage stability, the following crystalline polyester resin is preferable: in terms of molecular weight distribution by gel permeation chromatography (GPC) using o-dichlorobenzene soluble content, it is preferred that a peak be located in a range of 3.5 to 4.0, and that the half width of the peak be 1.5 or less in a molecular weight distribution plot with a horizontal axis representing log(M) and a vertical axis representing % by mass; and the crystalline polyester resin preferably has a weight average molecular weight (Mw) of 3,000 to 30,000, a number average molecular weight (Mn) of 1,000 to 10,000, and a ratio Mw/Mn of 1 to 10, more preferably a weight average molecular weight (Mw) of 5,000 to 15,000, a number average molecular weight (Mn) of 2,000 to 10,000, and a ratio Mw/Mn of 1 to 5.

The acid value of the crystalline polyester resin is not particularly limited, may be appropriately selected depending on the intended purpose, and is preferably 5 mgKOH/g or higher, more preferably 10 mgKOH/g or higher from the view point of increasing the affinity of the resin with paper and of achieving the intended low-temperature fixing ability. On the other hand, it is preferably 45 mgKOH/g or lower from the view point of improving offset resistance. Furthermore, the hydroxyl value of the crystalline polymer is preferably 0 mgKOH/g to 50 mgKOH/g, and more preferably 5 mgKOH/g to 50 mgKOH/g for achieving both the predetermined degree of low-temperature fixing ability and favorable charging property.

<Non-Crystalline Polyester Resin>

The binder resin in the present invention contains a non-crystalline polyester resin. The non-crystalline polyester resin used is preferably a non-crystalline unmodified polyester resin.

Notably, at leas part of the unmodified polyester resin is preferably mixed with a modified polyester resin obtained through crosslinking reaction and/or elongation reaction of a binder resin precursor of a modified polyester-based resin described below in detail. When they are partially mixed together, the formed toner can be increased in low-temperature fixing ability and hot offset resistance. Thus, preferably, the modified polyester resin and the unmodified polyester resin are similar in their constituent alcohol component and their constituent carboxylic acid component.

The alcohol component used in the non-crystalline polyester resin is a dihydric alcohol (diol). Examples thereof include C2-C36 alkylene glycols (e.g., ethylene glycol, 1,2-propylene glycol, 1,3-propylene glycol, 1,4-butylene glycol and 1,6-hexanediol); C4-C36 alkylene ether glycols (e.g., diethylene glycol, triethylene glycol, dipropylene glycol, polyethylene glycol, polypropylene glycol and polybutylene glycol); C6-C36 alicyclic diols (e.g., 1,4-cyclohexane dimethanol and hydrogenated bisphenol A); 1 to 30 mole adducts of the above-listed alicyclic diols with C2-C4 alkylene oxides (e.g., ethylene oxide (hereinafter abbreviated as "EO"), propylene oxide (hereinafter abbreviated as "PO") and butylene oxide (hereinafter abbreviated as "BO")); and 2 to 30 mole adducts of bisphenols (e.g., bisphenol A, bisphenol F and bisphenol S) with C2-C4 alkylene oxides (e.g., EO, PO and BO).

The alcohol component may contain a trihydric or higher (trihydric to octahydric or higher) alcohol in addition to the dihydric alcohol. Examples thereof include C3-C36 trihydric to octahydric or higher aliphatic polyalcohols (e.g., alkane polyols and intermolecular or intramolecular dehydration products thereof, such as glycerin, triethylolethane, trimethylolpropane, pentaerithritol, sorbitol, sorbitan, polyglycerin and pentaerithritol; sugars and derivatives thereof, such as sucrose and methylglycoside); 1 to 30 mole adducts of the above-listed aliphatic polyalcohols with C2-C4 alkylene oxides (e.g., EO, PO and BO); 2 to 30 mole adducts of trisphenols (e.g., trisphenol PA) with C2-C4 alkylene oxides (e.g., EO, PO and BO); and 2 to 30 mole adducts of novolac resins (e.g., phenol novolac and cresol novolac (average polymerization degree: 3 to 60)) with C2-C4 alkylene oxides (e.g., EO, PO and BO).

The carboxylic acid component used in the non-crystalline polyester resin is carboxylic acid having two carboxyl groups (dicarboxylic acids). Examples thereof include C4-C36 alkane dicarboxylic acids (e.g., succinic acid, adipic acid and sebacic acid), alkenylsuccinic acids (e.g., dodecenylsuccinic acid); C4-C36 aliphatic dicarboxylic acids (e.g., dimer acids (linoleic acid dimer); C4-C36 alkenylene dicarboxylic acids (e.g., maleic acid, fumaric acid, citraconic acid and mesaconic acid); and C8-C36 aromatic dicarboxylic acids (e.g., phthalic acid, isophthalic acid, terephthalic acid, derivatives thereof, and naphthalene dicarboxylic acid). Of these, preferred are C4-C20 alkene dicarboxylic and C8-C20 aromatic dicarboxylic acids. Also, there may be used polycarboxylic acids such as acid anhydrides and lower alkyl(C1-C4) esters of the above-listed carboxylic acids (e.g., methyl esters, ethyl esters and isopropyl esters).

The carboxylic acid component may contain a tri or higher (tri to hexa or higher) carboxylic acid in addition to the dicarboxylic acid. Examples thereof include C9-C20 aromatic polycarboxylic acids (e.g., trimellitic acid and pyromellitic acid); and vinyl copolymers of unsaturated carboxylic acids [number average molecular weight (hereinafter referred to as "Mn," which is measured through gel permeation chromatography (GPC)): 450 to 10,000] (styrene/maleic acid copolymers, styrene/acrylic acid copolymers, α-olefin/maleic acid copolymers and styrene/fumaric acid copolymers). Of these, C9 to C20 aromatic polycarboxylic acids are preferred, with trimellitic acid and pyromellitic acid being particularly preferred. Notably, the tri or higher polycarobxylic acids may be acid anhydrides and lower alkyl(C1-C4) esters of the above-listed carboxylic acids (e.g., methyl esters, ethyl esters and isopropyl esters).

The acid value of the unmodified polyester resin is generally 1 mgKOH/g to 50 mgKOH/g, preferably 5 mgKOH/g to 30 mgKOH/g. When the acid value thereof is 1 mgKOH/g or higher, it is easy for the toner to be negatively charged. Moreover, the affinity between toner and paper is increased upon fixing of the toner, which improves low-temperature fixing ability. Whereas when the acid value thereof is higher than 50 mgKOH/g, charge stability of the toner may be degraded, particularly depending on a change in the working environment. In the present invention, the unmodified polyester resin preferably has an acid value of 1 mgKOH/g to 50 mgKOH/g.

The hydroxyl value of the unmodified polyester resin is preferably 5 mgKOH/g or higher.

<Binder Resin Precursor>

Preferably, the binder resin further contains a binder resin precursor.

The toner of the present invention is preferably a toner obtained by dissolving or dispersing, in an organic solvent, at least a colorant, a releasing agent, a crystalline polyester resin, a binder resin precursor of a modified polyester-based resin, a non-crystalline polyester resin and other binder resin components, to thereby prepare an oil phase; dissolving, in the oil phase, a compound capable of being crosslinked and/or elongated with the binder resin precursor; dispersing the oil phase in an aqueous medium containing fine particles of a dispersing agent, to thereby prepare an emulsified dispersion liquid; allowing the binder resin precursor to undergo crosslinking reaction and/or elongation reaction in the emulsified dispersion liquid; and removing the organic solvent.

In other words, the toner of the present invention is preferably a toner obtained by preparing an oil phase containing binder resin components containing a crystalline polyester resin, a non-crystalline polyester resin and a binder resin precursor of a modified polyester-based resin, a colorant and a releasing agent; dissolving, in the oil phase, a compound capable of being crosslinked and/or elongated with the binder resin precursor; dispersing the oil phase, containing the compound dissolved therein, in an aqueous medium containing a dispersing agent, to thereby prepare a dispersion liquid; allowing the binder resin precursor to undergo crosslinking reaction and/or elongation reaction in the dispersion liquid; and removing the organic solvent.

The binder resin precursor is preferably a binder resin precursor of a modified polyester-based resin. Examples thereof include polyester prepolymers modified with isocyanate, epoxy, etc. The binder resin precursor is elongated with a compound having an active hydrogen group-containing compound (e.g., amines), contributing to improvement of the difference between the lower limit of the fixing temperature and the temperature at which hot offset occurs (i.e., the release range).

The polyester prepolymer can be easily synthesized by reacting, with a polyester resin (base reactant), an isocyanating agent, an epoxidizing agent, etc. which are conventionally known. Here, the polyester resin (base reactant) may be the above-described non-crystalline polyester resin (unmodified polyester resin).

Examples of the isocyanating agent include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic-aliphatic diisocyanate (e.g., α,α,α',α'-tetramethylxylylene diisocyanate); isocyanurates; products obtained by blocking the above polyisocyanates with phenol derivatives, oxime and caprolactam; and mixtures thereof.

The epoxidizing agent is typified by epichlorohydrin, etc.

The ratio of the isocyanating agent to the polyester resin (base reactant) is generally 5/1 to 1/1, preferably 4/1 to 1.2/1, still more preferably 2.5/1 to 1.5/1, in terms of the equivalent ratio [NCO]/[OH] of the isocyanate group [NCO] to the hydroxyl group [OH] of the polyester resin (base reactant). When the ratio [NCO]/[OH] exceeds 5, the formed toner is degraded in low-temperature fixing ability. When the [NCO] is less than 1, the urea content of the polyester prepolymer is lowered, and the formed toner is degraded in hot offset resistance.

The amount of the isocyanating agent contained in the polyester prepolymer is generally 0.5% by mass to 40% by mass, preferably 1% by mass to 30% by mass, still more preferably 2% by mass to 20% by mass. When the amount thereof is less than 0.5% by mass, the formed toner is degraded in hot offset resistance, and also is difficult to have both desired heat resistant storage stability and desired low-temperature fixing ability. Whereas when the amount thereof exceeds 40% by mass, the formed toner is degraded in low-temperature fixing ability.

The number of isocyanate groups contained per molecule of the polyester prepolymer is generally 1 or more, preferably 1.5 to 3 on average, more preferably 1.8 to 2.5 on average. When the number thereof is less than 1 per molecule, the urea-modified polyester resin obtained through elongation reaction is decreased in molecular weight, and thus, the formed toner is degraded in hot offset resistance.

The binder resin precursor preferably has a weight average molecular weight of $5\times10^3$ to $5\times10^4$.

<Compound Capable of being Crosslinked and/or Elongated with Binder Resin Precursor>

Examples of the compound capable of being crosslinked and/or elongated with the binder resin precursor include active hydrogen group-containing compounds such as amines. Examples of the amines include diamine compounds, tri or higher polyamines, aminoalcohol compounds, aminomercaptan compounds, amino acids and compounds whose amino groups are blocked.

Examples of the diamine compounds include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminecyclohexane and isophoronediamine); and aliphatic diamines (e.g., ethylenediamine, tetramethylenediamine and hexamethylenediamine).

Examples of the tri or higher polyamine include diethylenetriamine and triethylenetetramine.

Examples of the aminoalcohol compound include ethanolamine and hydroxyethylaniline.

Examples of the aminomercaptan compound include aminoethyl mercaptan and aminopropyl mercaptan.

Examples of the amino acid include aminopropionic acid and aminocaproic acid.

Examples of the amino-blocked compound include oxazolidine compounds and ketimine compounds derived from the amines and ketones (e.g., acetone, methyl ethyl ketone and methyl isobutyl ketone).

Among these amines, preferred are diamine compounds, mixtures of diamine compounds and a small amount of a polyamine compound, and amino-blocked diamine compounds.

Notably, the urea-modified polyester resins may be used in combination with a polyester resin modified with a chemical bond other than the urea bond, in addition to the unmodified non-crystalline polyester resin. For example, a urethane-modified polyester resin may be used in combination.

When the modified polyester resin (e.g., urea-modified polyester resin) is contained in the organic solvent, the modified polyester resin can be produced by, for example, the one-shot method.

As an example, a method for producing the urea-modified polyester resin will be described.

First, a polyol and a polycarboxylic acid are heated to a temperature of 150° C. to 280° C. in the presence of a catalyst such as tetrabutoxy titanate or dibutyltin oxide. Subsequently, the formed water is removed under reduced pressure if necessary, to prepare a polyester having a hydroxyl group. Thereafter, the thus-prepared polyester is reacted with a polyisocyanate at a temperature of 40° C. to 140° C. to prepare a polyester prepolymer having an isocyanate group. Further, the thus-prepared polyester prepolymer is reacted with an amine at a temperature of 0° C. to 140° C. to prepare a urea-modified polyester resin.

This urea-modified polyester resin preferably has a number average molecular weight of 1,000 to 10,000, more preferably 1,500 to 6,000.

Notably, a solvent may be used if necessary, when the hydroxyl group-containing polyester resin is reacted with the polyisocyanate and when the isocyanate group-containing polyester prepolymer is reacted with the amine.

Examples of the solvent include those inert with respect to an isocyanate group, such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran).

Notably, the unmodified polyester resin is produced in a manner similar to that performed in the above production for the hydroxyl group-containing polyester resin, and then is dissolved in and mixed with the solution obtained after completion of the production of the urea-modified polyester resin.

In the present invention, the binder resin contained in the oil phase may contain the crystalline polyester resin, the non-crystalline polyester resin, the binder resin precursor and the unmodified resin. In addition, the binder resin may further contain other binder resin components than the above binder resins. The binder resin preferably contains a polyester resin. The amount of the polyester resin contained is preferably 50% by mass or more. When the amount of the polyester resin is less than 50% by mass, the formed toner may be decreased in low-temperature fixing ability. It is particularly preferred that all the binder resin components be polyester resins.

Notably, a binder resin component other than the polyester resins is not particularly limited and may be appropriately selected depending on the intended purpose. Examples thereof include styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes; epoxy resins; epoxy polyol resins; polyurethane resins; polyamide resins; polyvinyl butyrals; polyacrylic acid resins; rosin; modified rosin; terpene resins; aliphatic or alicyclic hydrocarbon resins; aromatic petroleum resins; chlorinated paraffins; and paraffin waxes.

<Other Components>

If necessary, the toner of the present invention may contain other known materials used in a toner, such as a colorant, a releasing agent, a charge controlling agent and fine resin particles (fine organic particles). Moreover, after removal of the organic solvent, these additives may be deposited on the toner surface.

<<Colorant>>

The colorant usable in the present invention is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof. The amount of the colorant contained in the toner is generally 1% by mass to 15% by mass, preferably 3% by mass to 10% by mass.

In the present invention, the colorant may be mixed with a binder resin to form a masterbatch. Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

<<Releasing Agent>>

The releasing agent contained in the toner of the present invention is preferably a wax having a melting point of 50° C. to 120° C.

Such a wax can effectively act as the releasing agent at the interface between a fixing roller and a toner, and thus, can improve hot offset resistance without applying onto the fixing roller a releasing agent such as oil.

Notably, the melting point of the wax is determined by measuring maximum endothermic peak using a TG-DSC system TAS-100 (product of Rigaku Corporation) which is a differential scanning calorimeter.

The below-listed materials can be used as the releasing agent.

Examples of waxes include vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum).

Examples of waxes other than the above natural waxes include synthetic hydrocarbon waxes (e.g., Fischer-Tropsch waxes and polyethylene waxes); and synthetic waxes (e.g., ester waxes, ketone waxes and ether waxes).

Further examples include fatty acid amides such as 1,2-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

<<Charge Controlling Agent>>

The toner of the present invention may further contain a charge controlling agent, if necessary. The charge controlling agent is not particularly limited and may be appropriately selected from those known in the art depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD); quaternary ammonium salt molybdenum complex TP-302 and TP-415 (these products are of Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG); LRA-901 and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge controlling agent contained is not determined flatly and is varied depending on the type of the binder resin used, on an optionally used additive, and on the toner production method used (including the dispersion method used). The amount of the charge controlling agent is preferably 0.1 parts by mass to 10 parts by mass, more preferably 0.2 parts by mass to 5 parts by mass, per 100 parts by mass of the binder resin. When the amount thereof is more than 10 parts by mass, the formed toner has too high chargeability, resulting in that the charge controlling agent exhibits reduced effects. As a result, the electrostatic force increases between the developing roller and the toner, decreasing the fluidity of the toner and forming an image with reduced color density. When the amount thereof is less than 0.1 parts by mass, the effects of the charge controlling agent are not be obtained satisfactorily.

These charge controlling agent and release agent may be melt-kneaded together with a masterbatch or binder resin, and then dissolved or dispersed. Needless to say, they may be added to an organic solvent simultaneously with the masterbatch or binder resin, or may be fixed on the surfaces of the formed toner particles.

<<External Additive>>

The toner of the present invention may contain an external additive for assisting its flowability, developability, chargeability and cleanability.

Examples of the external additive capable of assisting flowability, developability and chargeability include fine inorganic particles and fine polymer particles, with fine inorganic particles being preferred.

Specific examples of such inorganic microparticles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

The fine inorganic particles preferably have a primary particle diameter of 5 nm to 2 μm (2,000 nm), more preferably 5 nm to 500 nm. Also, the specific surface area thereof as measured with the BET method is preferably 20 $m^2/g$ to 500 $m^2/g$. The amount of the fine inorganic particles used is preferably 0.01% by mass to 5% by mass, more preferably 0.01% by mass to 2.0% by mass.

Examples of the fine polymer particles include polystyrenes, methacrylic acid esters, acrylate copolymers, polycondensates (e.g., silicone, benzoguanamine and nylon) and polymer particles of thermosetting resins, which are produced through soap-free emulsion polymerization, suspension polymerization and dispersion polymerization.

A fluidizing agent is an agent improving hydrophobic properties through surface treatment, and is capable of inhibiting the degradation of flowability or chargeability under high humidity environment. Preferred examples of the fluidizing agent include silane coupling agents, silylation agents, silane coupling agents having a fluorinated alkyl group, organotitanate coupling agents, aluminum coupling agents, silicone oils, and modified silicone oils.

The cleanability improver; i.e., an external additive for assisting cleanability, is an agent removing the developer remaining after transfer on a photoconductor or a primary transfer member. Specific examples of the cleanability improver include metal salts of fatty acids such as stearic acid (e.g., zinc stearate and calcium stearate), fine polymer particles formed by soap-free emulsion polymerization, such as fine polymethylmethacrylate particles and fine polystylene particles. The fine polymer particles preferably have a relatively narrow particle size distribution. It is preferable that the volume average particle diameter thereof be 0.01 μm to 1 μm.

(Production of Toner in Aqueous Medium)

The aqueous medium used in the present invention may be water alone or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

The toner materials (toner composition) forming toner particles; e.g., a binder resin precursor, a colorant, a releasing agent, a crystalline polyester resin, a charge controlling agent and an unmodified polyester resin, or dispersion liquids of the toner materials may be mixed together in an aqueous medium as dispersoids (emulsified dispersion liquid, dispersion liquid). Preferably, these toner materials are mixed together in advance, and the resultant mixture is added to an aqueous medium for dispersion. Also, in the present invention, the toner materials other than the binder resin, such as the colorant, the releasing agent and the charge controlling agent, are not necessarily added to the aqueous medium before particle formation, and they may be added thereto after particle formation. For example, the colorant may be added by a known dying method to the particles containing no colorant.

The dispersion method is not particularly limited. There can be used known dispersers employing, for example, low-speed shearing, high-speed shearing, friction, high-pressure jetting and ultrasonic wave. In order for the dispersoid to have a particle diameter of 2 μm to 20 μm, a high-speed shearing disperser is preferably used. In use of the high-speed shearing disperser, the rotating speed is not particularly limited and is generally 1,000 rpm to 30,000 rpm, preferably 5,000 rpm to 20,000 rpm. Also, the dispersion time is not particularly limited and is generally 0.1 min to 60 min when a batch method is employed. The temperature during dispersion is generally 0° C. to 80° C. (in a pressurized state), preferably from 10° C. to 40° C.

The amount of the aqueous medium used is generally 100 parts by mass to 1,000 parts by mass, per 100 parts by mass of the toner components. When the amount is less than 100 parts by mass, the toner composition cannot be sufficiently dispersed, resulting in failure to form toner particles having a predetermined particle diameter. Meanwhile, use of the aqueous medium more than 1,000 parts by mass is economically disadvantageous. If necessary, a dispersing agent may be used. Use of the dispersing agent is preferred from the viewpoints of attaining a sharp particle size distribution and realizing a stable dispersion state.

For reacting the polyester prepolymer (binder resin precursor) with an active hydrogen group-containing compound, the active hydrogen group-containing compound may be added to the aqueous medium for reaction before the toner composition is dispersed therein. Alternatively, the active hydrogen group-containing compound may be added to the aqueous medium after the toner composition has been dispersed therein, causing reaction from the interfaces between the formed particles. In this case, a modified polyester is formed preferentially on the surfaces of the toner particles from the polyester prepolymer, which can provide concentration gradient from the surface to the core of the particles.

<Dispersing Agent>

Examples of a dispersing agent for emulsifying and dispersing, in aqueous liquid (aqueous medium), the oil phase in which the toner composition has been dispersed include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

Also, a fluoroalkyl group-containing surfactant can exhibit its dispersing effects even in a small amount.

Examples of the fluoroalkyl group-containing surfactant include fluoroalkyl group-containing anionic surfactants and fluoroalkyl group-containing cationic surfactants.

Examples of the fluoroalkyl group-containing anionic surfactants include fluoroalkyl carboxylic acids having 2 to 10 carbon atoms and metal salts thereof, disodium perfluorooctanesulfonylglutamate, sodium 3-[omega-fluoroalkyl(C6 to C11)oxy)-1-alkyl(C3 or C4) sulfonates, sodium 3-[omega-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl (C6 to C10)-N-ethylsulfonylglycin and monoperfluoroalkyl (C6 to C16) ethylphosphates.

Examples of commercially available products of the above-listed anionic surfactants include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F100 and F150 (these products are of NEOS COMPANY LIMITED).

Examples of the fluoroalkyl group-containing cationic surfactant include fluoroalkyl group-containing primary, secondary or tertiary aliphatic compounds, aliphatic quaternary ammonium salts (e.g., perfluoroalkyl(C6 to C10)sulfonamide propyltrimethylammonium salts), benzalkonium salts, benzetonium chloride, pyridinium salts and imidazolinium salts. Examples of commercially available products of the above-listed cationic surfactants include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); EFTOP EF-132 (product of Tohchem Products Co., Ltd.); and FUTARGENT F-300 (product of Neos COMPANY LIMITED).

In addition, there can be used tricalcium phosphate, calcium carbonate, titanium oxide, colloidal silica, hydroxyapatite, and other poorly water-soluble inorganic dispersing agents.

Further, a polymeric protective colloid or water-insoluble fine organic particles may be used to stabilize dispersed droplets. Examples of the polymeric protective colloid or water-insoluble fine organic particles include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds of thereof, acid chlorides (e.g., acrylic acid chloride and methacrylic acid chloride); nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles (toner particles). Also, the calcium phosphate may be removed through enzymatic decomposition.

Alternatively, the dispersing agent used may remain on the surfaces of the toner particles. But, the dispersing agent is preferably removed through washing in terms of chargeability of the formed toner.

Furthermore, in order to decrease the viscosity of the toner composition, there can be used a solvent in which a modified polyester obtained through reaction of polyester prepolymers can be dissolved. Use of the solvent is preferred from the viewpoint of attaining a sharp particle size distribution. The solvent used is preferably a volatile solvent having a boiling point lower than 100° C., since solvent removal can be easily performed. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination.

Among them, aromatic solvents (e.g., toluene and xylene); and methylene chloride, 1,2-dichloroethane, chloroform and halogenated hydrocarbons (e.g., carbon tetrachloride) are preferred. The solvent is generally used in an amount of 0 parts by mass to 300 parts by mass, preferably 0 parts by mass to 100 parts by mass, more preferably 25 parts by mass to 70 parts by mass, per 100 parts by mass of the prepolymer. The solvent used is removed under normal or reduced pressure from the reaction mixture obtained after completion of elongation and/or crosslinking reaction.

The time required for elongation and/or crosslinking reaction depends, for example, on reactivity between a polyester prepolymer used and an active hydrogen group-containing compound used, and is generally 10 min to 40 hours, preferably 30 min to 24 hours. The reaction temperature is generally 0° C. to 100° C., preferably 10° C. to 50° C. If necessary, a known catalyst may be used. Specific examples thereof include tertiary amines (e.g., triethylamine) and imidazole.

Examples of the method for removing the organic solvent from the emulsified dispersion liquid include a method in which the entire reaction system is gradually increased in temperature to completely evaporate the organic solvent contained in the liquid droplets; and a method in which the emulsified dispersion liquid is sprayed in a dry atmosphere to completely remove and evaporate the water-insoluble organic solvent contained in the liquid droplets and the aqueous dispersing agent, whereby fine toner particles are formed. The dry atmosphere in which the emulsified dispersion liquid is sprayed generally uses heated gas (e.g., air, nitrogen, carbon dioxide and combustion gas), especially, gas flow heated to a temperature equal to or higher than the boiling point of the solvent used. By removing the organic solvent even in a short time using, for example, a spray dryer, a belt dryer or a rotary kiln, the resultant product has satisfactory quality.

When the emulsified or dispersed particles having a broad particle size distribution are subjected to washing and drying treatments as is, the washed and dried particles may be classified so as to have a desired particle size distribution.

Classification is performed by removing very fine particles using a cyclone, a decanter, a centrifugal separator, etc. in the liquid. Needless to say, classification may be performed on powder obtained after drying but is preferably performed in the liquid from the viewpoint of high efficiency. The thus-removed unnecessary fine particles or coarse particles may be returned to and dissolved in the organic solvent, where the unnecessary particles can be used for forming toner particles. In this case, the unnecessary fine or coarse particles may be in a wet state.

The dispersing agent used is preferably removed from the obtained dispersion liquid to the greatest extent possible. Preferably, the dispersing agent is removed through the above-described classification.

The resultant dry toner particles may be mixed with other particles such as releasing agent fine particles, charge controlling agent fine particles and colorant fine particles, and also a mechanical impact may be applied to the mixture for immobilization or fusion of other particles on the toner surface, to thereby prevent the other particles from dropping off from the surfaces of the toner particles.

Examples of the method for applying a mixing or mechanical impact include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate. Examples of apparatuses used in these methods include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

[Acid Value of Toner]

The acid value of the toner of the present invention is a factor for improving the low-temperature fixing ability and hot offset resistance. The acid value of the toner reflects a terminal carboxyl group of the unmodified polyester resin. The acid value of the unmodified polyester resin is preferably adjusted to 0.5 KOHmg/g to 40 KOHmg/g from the viewpoint of controlling the low-temperature fixing ability; i.e., the lower limit of the fixing temperature, and the temperature at which hot offset occurs.

When the acid value thereof is more than 40 KOHmg/g, elongation reaction and/or crosslinking reaction for forming a reactive modified polyester does not sufficiently proceed, giving adverse effects to the hot offset resistance. Whereas when the acid value thereof is less than 0.5 KOHmg/g, the basic compound cannot contribute to dispersion stability during production. Thus, elongation and/or crosslinking reaction for forming a reactive modified polyester resin proceeds to an undesired extent, leading to degradation of production stability.

[Glass Transition Temperature Tg of Toner]

The Tg1st of the toner of the present invention is preferably 45° C. to 65° C. The toner having such a Tg1st is increased in low-temperature fixing ability, heat resistant storage stability and durability. The toner having a Tg1st lower than 45° C. may involve blocking in developing apparatuses and filming on photoconductors. The toner having a Tg1st exceeding 65° C. may be decreased in low-temperature fixing ability. The Tg1st of the toner is more preferably 50° C. to 60° C.

The endothermic shoulder temperature; i.e., Tg2nd, of the toner of the present invention is preferably 20° C. to 40° C. The toner having a Tg2nd lower than 20° C. may involve blocking in developing apparatuses and filming on photoconductors. The toner having a Tg2nd exceeding 40° C. may be decreased in low-temperature fixing ability.

Notably, the Tg1st is a glass transition temperature measured at the first temperature raising, and the Tg2nd is a glass transition temperature measured at the second temperature raising. Their measurement methods will be described below in detail.

[Volume Average Particle Diameter and Particle Distribution of Toner]

The volume average particle diameter of the toner of the present invention is preferably 3 μm to 7 μm. The ratio of the volume average particle diameter to the number average particle diameter is preferably 1.2 or lower. The toner of the present invention preferably contains particles having a particle diameter of 2 μm or less in an amount of 1% by number to 10% by number.

[Peak Value Measured Through X-Ray Diffraction and Measurement Method for Peak Half Width]

X-ray diffraction measurement of the crystalline polyester resin can be performed with a crystal analysis X ray diffraction device (X'PERT MRDX'PERT MRD, product of Philips Co.). The measurement method will be described below.

First, a measurement sample is ground in a mortar to prepare a powdery sample. A sample holder is uniformly coated with the resultant powdery sample. Thereafter, the sample holder is set in a diffraction device, followed by measurement, to thereby obtain a diffraction spectrum.

Among the obtained diffraction peaks, the peaks appearing in the range of $20° < 2\theta < 25°$ are defined as P1, P2, . . . in the order of increasing peak intensity.

Here, FIG. 1 shows one exemplary X-ray diffraction spectrum of the crystalline polyester resin contained in the toner of the present invention. As shown in FIG. 1, the peaks in the present invention appear in the form of convex pattern with respect to the baseline of the X-ray diffraction spectrum.

Figure 2:
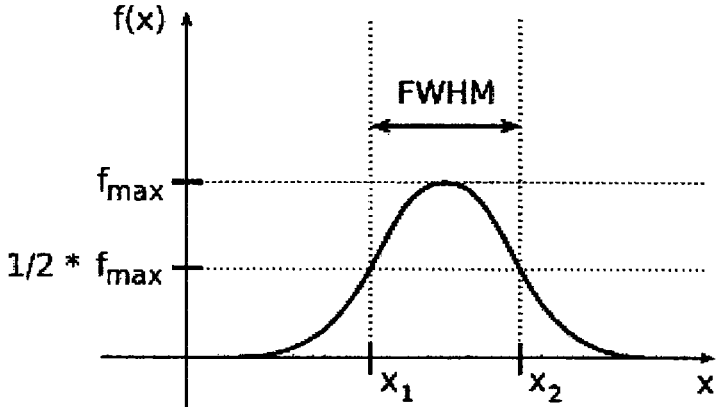
FIG. 2 is an explanatory graph for the half width (FWHM) of a peak in an X-ray diffraction spectrum of a crystalline polyester resin.

As shown in FIG. 2, the peak half width (FWHM) is defined as difference x2−x1 (=|x1−x2|) where x1 and x2 each denote a point giving half ($\frac{1}{2} \times f_{max}$) of the maximum peak intensity $f_{max}$. Note that x2 is greater than x1.

The measurement conditions of the X-ray diffraction will be described below.

[Measurement Conditions]

Tension kV: 45 kV
Current: 40 A
MPSS
Upper
Gonio
Scanmode: continuous
Start angle: 3°
End angle: 35°
Angle Step: 0.02°
Lucident beam optics
Divergence slit: Div slit 1/2
Difflection beam optics
Anti scatter slit: As Fixed 1/2
Receiving slit: Prog rec slit (Method for Extracting Crystalline Polyester Resin from Toner)

The method for extracting the crystalline polyester resin from the toner is, for example, the following method.

Specifically, the toner is dissolved in a solvent capable of dissolving the toner; e.g., an organic solvent such as THF, and the resultant solution is analyzed through GPC using THF as a mobile phase. The obtained eluate is treated with, for example, a fraction collector, to thereby separate the fractions of interest.

The eluate of each fraction is evaporated/dried with, for example, an evaporator. Then, the obtained solid is dissolved in a deuterated solvent such as deuterated chloroform or deuterated THF, and the resultant solution is subjected to 1H-NMR measurement. The ratio of each constituent monomer in the eluate can be calculated from the integral ratio of each element.

In an alternative method, the eluate is concentrated and hydrolyzed with sodium hydroxide or the like, and the decomposed product can be qualitatively and quantitatively analyzed by high performance liquid chromatography (HPLC) to calculate the ratio of constituent monomers.

Through the above analysis of each fraction, the fraction containing the crystalline polyester resin in the largest amount is identified. The fractionating interval is set so that the crystalline polyester resin is contained in an amount of 95% by mass or more, whereby the crystalline polyester resin can be isolated. Here, a component containing the crystalline polyester resin in an amount of 95% by mass or more is defined as a crystalline polyester resin component.

The following method can be employed in addition to the above-described extraction through GPC. Specifically, the crystalline polyester resin is separated from the non-crystalline polyester resin by utilizing the difference in dissolvability to a polar solvent; i.e., the crystalline polyester resin has low dissolvability to the polar solvent. Subsequently, the thus-isolated crystalline polyester resin is subjected to 1H-NMR measurement or the hydrolyzed product thereof is analyzed through HPLC, to calculate the ratio of each constituent monomer. The extraction solvent or the concentration thereof is adjusted so that the crystalline polyester resin is contained in an amount of 95% by mass or more, for isolating the crystalline polyester resin.

The crystalline polyester resin is extracted from the toner by the above-described extraction method, and is evaluated for properties. That is, the evaluation of the crystalline polyester resin extracted from the toner by the above-described extraction method is comparable to the evaluation of the crystalline polyester resin serving as a raw material of the toner. As described in, for example, the following Examples, the peak value and peak half width in X-ray diffraction measurement can be measured precisely.

[Evaluation for Dissolvability of Crystalline Polyester Resin to Organic Solvent]

The dissolvability of the crystalline polyester resin to the organic solvent is measured by the following method.

First, 20 g of the crystalline polyester resin and 80 g of the organic solvent are stirred for 1 hour at a predetermined temperature.

Separately, a filter paper No. 4 for KIRIYAMA funnel (product of Kiriyama glass Co.) is set to a KIRIYAMA funnel (product of Kiriyama glass Co.). Using the KIRIYAMA funnel, the above-obtained solution is subjected to aspiration filtration with an aspirator at a predetermined temperature, to thereby separate the organic solvent from the crystalline polyester resin.

Furthermore, the thus-separated organic solvent is heated for 1 hour at a temperature higher by 50° C. than the boiling point of the organic solvent, to thereby evaporate the organic solvent. The amount of the crystalline polyester resin dissolved in the organic solvent is calculated on the basis of a change in mass before and after heating.

[Measurement Methods for Acid Value and Hydroxyl Value]

The hydroxyl value is measured according to the method of JIS K0070-1966.

Specifically, first, 0.5 g of a sample is accurately weighed in a 100 mL measuring flask, and then 5 mL of an acetylation reagent is added thereto. Next, the measuring flask is heated for 1 hour to 2 hours in a hot water bath set to 100° C.±5° C., and is then taken out from the hot water bath and left to cool. In addition, water is added to the measuring flask, which is then shaken to decompose acetic anhydride. Next, for completely decomposing acetic anhydride, the flask is heated again in the hot water bath for 10 minutes or longer and then left to cool. Thereafter, the wall of the flask is thoroughly washed with an organic solvent.

Then, a potentiometric automatic titrator DL-53 (product of Mettler-Toledo K.K.) and an electrode DG113-SC (product of Mettler-Toledo K.K.) are used to measure the hydroxyl value at 23° C. The measurements are analyzed with analysis software LabX Light Version 1.00.000. The calibration for this apparatus is performed using a solvent mixture of toluene (120 mL) and ethanol (30 mL).

The measurement conditions are as follows.

| [Measurement Conditions] | |
|---|---|
| Stir | |
| Speed[%] | 25 |
| Time[s] | 15 |
| EQP titration | |
| Titrant/Sensor | |
| Titrant | $CH_3ONa$ |
| Concentration[mol/L] | 0.1 |
| Sensor | DG115 |
| Unit of measurement | mV |
| Predispensing to volume | |
| Volume[mL] | 1.0 |
| Wait time[s] | 0 |
| Titrant addition | Dynamic |
| dE(set)[mV] | 8.0 |
| dV(min)[mL] | 0.03 |
| dV(max)[mL] | 0.5 |

-continued

| [Measurement Conditions] | |
|---|---|
| Measure mode | Equilibrium controlled |
| dE[mV] | 0.5 |
| dt[s] | 1.0 |
| t(min)[s] | 2.0 |
| t(max)[s] | 20.0 |
| Recognition | |
| Threshold | 100.0 |
| Steepest jump only | No |
| Range | No |
| Tendency | None |
| Termination | |
| at maximum volume[mL] | 10.0 |
| at potential | No |
| at slope | No |
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

In the present invention, the acid value is measured according to the method of JIS K0070-1992.

Specifically, first, 0.5 g of a sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator DL-53 (product of Mettler-Toledo K.K.) and an electrode DG113-SC (product of Mettler-Toledo K.K.) are used to measure the acid value at 23° C. The measurements are analyzed with analysis software LabX Light Version 1.00.000. The calibration for this apparatus is performed using a solvent mixture of toluene (120 mL) and ethanol (30 mL).

The measurement conditions are the same as those set for measuring the hydroxyl value.

The acid value can be measured in the above-described manner. Specifically, the sample solution is titrated with a pre-standardized 0.1N potassium hydroxide/alcohol solution and then the acid value is calculated from the titer using the equation: acid value (KOHmg/g)=titer (mL)×N×56.1 (mg/mL)/mass of sample (g), where N is a factor of 0.1N potassium hydroxide/alcohol solution.

[Measurement Methods for Melting Point of Crystalline Polyester Resin and Glass Transition Temperature Tg of Toner]

In the present invention, the melting point of the crystalline polyester resin and the glass transition temperature of the toner can be measured with, for example, a DSC system (a differential scanning calorimeter) ("DSC-60," product of Shimadzu Corporation).

Specifically, the melting point and the glass transition temperature a measurement sample can be measured following the below-described procedure.

First, about 5.0 mg of a measurement sample (crystalline polyester resin or toner) is added to an aluminum sample container. The sample container is placed on a holder unit and set in an electric furnace. Next, in a nitrogen atmosphere, the sample container is heated from 0° C. to 150° C. at a temperature increasing rate of 10° C./min. Thereafter, the sample container is cooled from 150° C. to 0° C. at a temperature decreasing rate of 10° C./min, and then heated to 150° C. at a temperature increasing rate of 10° C./min. In this process, the DSC curve of the sample is measured with a differential scanning calorimeter ("DSC-60," product of Shimadzu Corporation). From the obtained DSC curves, the glass transition temperature can be obtained at each temperature raising with the analysis program of the DSC-60 system. Specifically, the glass transition temperature of the measurement sample at the first temperature raising is determined from the DSC curve of the first temperature raising with "endothermic shoulder temperature" of the analysis program. The glass transition temperature of the measurement sample at the second temperature raising is determined from the DSC curve of the second temperature raising with "endothermic shoulder temperature" of the analysis program. Similarly, from the obtained DSC curves, the melting point can be obtained at each temperature raising with the analysis program of the DSC-60 system. Specifically, the melting point of the measurement sample at the first temperature raising is determined from the DSC curve of the first temperature raising with "endothermic shoulder temperature" of the analysis program. The melting point of the measurement sample at the second temperature raising is determined from the DSC curve of the second temperature raising with "endothermic shoulder temperature" of the analysis program.

In the present invention, the glass transition temperature of a toner (i.e., the measurement sample) at the first temperature raising is defined as Tg1st, and that at the second temperature raising is defined as Tg2nd.

Also, in the present invention, the melting point of a crystalline polyester resin (i.e., the measurement sample) at the second temperature raising is defined as the melting point of the crystalline polyester resin.

[Measurement Method for Particle Size Distribution]

In the present invention, the particle size distribution of the toner is measured by the Coulter counter method.

Examples of employable particle size analyzer include a Coulter Counter TA-II and Coulter Multisizer II (these products are of Beckman Coulter, Inc.).

In the present invention, the Coulter Counter TA-II was used with being connected to an interface (product of The Institute of Japanese Union of Scientists & Engineers), which outputs number and volume distributions, and to a personal computer PC9801 (product of NEC Co.).

Specifically, first, a surfactant (0.1 mL to 5 mL), preferably alkylbenzene sulfonate, is added as a dispersing agent to an electrolyte solution (100 mL to 150 mL). Here, the electrolyte solution is an about 1% by mass aqueous solution prepared using 1st grade sodium chloride, and examples of commercially available products thereof include ISOTON-II (product of Beckman Coulter, Inc.). Subsequently, a sample (toner) of 2 mg to 20 mg is suspended in the above-obtained electrolyte solution. The resultant electrolyte solution is dispersed with an ultrasonic wave disperser for 1 minute to 3 minutes. The thus-obtained dispersion liquid is analyzed with the above-described apparatus using an aperture of 100 μm to measure the number and volume of the toner. Then, the volume particle size distribution and number particle size distribution are calculated from the obtained values.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive);

10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

[Measurement of Ultrafine Toner Particles Having a Particle Diameter of 2 μm or Smaller]

In the present invention, ultrafine toner particles having a particle diameter of 2 μm or smaller are measured with the flow-type particle image analyzer ("FPIA-2100," product of Sysmex Co.) and then the measurements were analyzed by analysis software FPIA-2100 Data Processing Program for FPIA version 00-10. Specifically, 0.1 mL to 0.5 mL of a 10% by mass surfactant (alkylbenzene sulfonate, Neogen SC-A, product of Daiichi Kogyo Seiyaku Co.) was added to a 100 mL-glass beaker, and 0.1 g to 0.5 g of toner base particles to which no external additive had been added was added thereto, followed by stirring with a microspartel. Subsequently, 80 mL of ion-exchange water was added to the beaker, and the obtained dispersion liquid was dispersed with an ultrasonic wave disperser (product of Honda Electronics Co.) for 3 minutes. The resultant dispersion liquid was measured for shape/distribution of toner using FPIA-2100 until the toner density falls within a range of 5,000/μL to 15,000/μL. Notably, in this method, it is important that the toner density of the dispersion liquid is adjusted to 5,000/μL to 15,000/μL, considering attaining measurement reproducibility. In order for the toner density to fall within the above range, the preparation conditions for the dispersion liquid must be modified; i.e., the amounts of a surfactant and toner particles added must be adjusted.

The amount of the surfactant required varies depending on the hydrophobicity of the toner particles. Specifically, when it is added in a large amount, bubbles generated causes a noise; whereas when it is added in a small amount, the toner particles cannot be provided with sufficient wettability and thus a sufficient dispersion state cannot be attained. Meanwhile, the amount of the toner particles added varies depending on the particle diameter thereof. Specifically, the toner with a small particle diameter must be added in a small amount, and the toner with a large particle diameter must be added in a large amount. For example, when the toner with a particle diameter of 3 μm to 7 μm is added in an amount of 0.1 g to 0.5 g, the toner density of the formed dispersion liquid can be adjusted to 5,000/μL to 15,000/μL.

(Developer)

A developer of the present invention contains the toner of the present invention. Preferably, the developer is a two-component developer containing a carrier in addition to the toner. In the two-component developer, the amount of the toner is preferably 1 part by mass to 10 parts by mass relative to 100 parts by mass of the carrier.

Notably, the developer of the present invention may be a one-component developer containing no carrier; i.e., a magnetic toner or a non-magnetic toner.

The carrier may be conventionally known carriers such as iron powder, ferrite powder, magnetite powder and magnetic resin carriers having a particle diameter of about 20 μm to about 200 μm.

The carrier may be coated with a coating resin. Examples of the coating resin include amino-based resins such as urea-formaldehyde resins, melamine resins, benzoguanamine resins, urea resins and polyamide resins; epoxy resins; polyvinyl-based resins such as acryl resins, polymethyl methacrylates, polyacrylonitriles, polyvinyl acetates, polyvinyl alcohols and polyvinyl butyrals; polyvinylidene-based resins; polystyrene-based resins such as polystyrenes and styrene-acryl copolymer resins; halogenated olefin resins such as polyvinyl chloride; polyester-based resins such as polyethylene terephthalates and polybutylene terephthalates; polycarbonate-based resins, polyethylenes, polyvinyl fluorides, polyvinylidene fluorides, polytrifluoroethylenes, polyhexafluoropropylenes, copolymers formed of vinylidene fluoride and an acryl monomer, a copolymer formed of vinylidene fluoride and vinyl fluoride, fluoroterpolymers such as terpolymers formed of tetrafluoroethylene, vinylidene fluoride and non-fluoride monomers, and silicone resins.

If necessary, the coating resin may contain conductive powder such as metal powder, carbon black, titanium oxide, tin oxide and zinc oxide.

The conductive powder preferably has a volume average particle diameter of 1 μm or smaller. When the volume average particle diameter exceeds 1 μm, it may be difficult for the conductive powder to be controlled in electrical resistance.

EXAMPLES

The present invention will next be described in detail by way of Examples, which should not be construed as limiting the present invention thereto. In Examples, the unit "part(s)" is part(s) by mass.

Production Example 1

Synthesis of Crystalline Polyester Resin 1

A 5 L four-neck flask equipped with a nitrogen-introducing pipe, a drainpipe, a stirrer and a thermocouple was charged with 1,10-decanedioic acid (2,320 g), 1,8-octanediol (1,430 g) and hydroquinone (4.9 g), followed by reaction at 200° C. for 10 hours. Thereafter, the reaction mixture was allowed to react at 230° C. for 3 hours and further react at 8.3 kPa for 4 hours, to thereby produce crystalline polyester resin 1. The thus-produced crystalline polyester resin 1 was measured for X ray diffraction pattern (the result is shown in Table 1), melting point, dissolvability to an organic solvent, and molecular weight (the results are shown in Table 2).

Notably, the molecular weight was measured by GPC using soluble matter of crystalline polyester resin 1 in o-dichlorobenzene. The below crystalline polyester resins 2 to 10 were measured for molecular weight in the same manner.

Production Example 2

Synthesis of Crystalline Polyester Resin 2

A 5 L four-neck flask equipped with a nitrogen-introducing pipe, a drainpipe, a stirrer and a thermocouple was charged with 1,10-decanedioic acid (2,300 g), 1,8-octanediol (1,430 g) and hydroquinone (4.9 g), followed by reaction at 190° C. for 4 hours. Thereafter, the reaction mixture was allowed to react at 220° C. for 3 hours and further react at 7.8 kPa for 1 hour, to thereby produce crystalline polyester resin 2. The thus-produced crystalline polyester resin 2 was measured for X ray diffraction pattern (the result is shown in Table 1), melting point, dissolvability to an organic solvent, and molecular weight (the results are shown in Table 2).

Production Example 3

Synthesis of Crystalline Polyester Resin 3

A 5 L four-neck flask equipped with a nitrogen-introducing pipe, a drainpipe, a stirrer and a thermocouple was charged with 1,10-decanedioic acid (2,400 g), 1,8-octanediol (1,530 g) and hydroquinone (4.9 g), followed by reaction at 200° C. for 10 hours. Thereafter, the reaction mixture was allowed to react at 220° C. for 3 hours and further react at 8.3 kPa for 2 hours, to thereby produce crystalline polyester resin 3. The thus-produced crystalline polyester resin 3 was measured for X ray diffraction pattern (the result is shown in Table 1), melting point, dissolvability to an organic solvent, and molecular weight (the results are shown in Table 2).

Production Example 4

Synthesis of Crystalline Polyester Resin 4

A 5 L four-neck flask equipped with a nitrogen-introducing pipe, a drainpipe, a stirrer and a thermocouple was charged with 1,10-decanedioic acid (2,300 g), 1,10-dodecanediol (2,030 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 4. The thus-produced crystalline polyester resin 4 was measured for X ray diffraction pattern (the result is shown in Table 1), melting point, dissolvability to an organic solvent, and molecular weight (the results are shown in Table 2).

Production Example 5

Synthesis of Crystalline Polyester Resin 5

A 5 L four-neck flask equipped with a nitrogen-introducing pipe, a drainpipe, a stirrer and a thermocouple was charged with 1,10-decanedioic acid (2,400 g), ethylene glycol (620 g) and hydroquinone (4.9 g), followed by reaction at 200° C. for 10 hours. Thereafter, the reaction mixture was allowed to react at 220° C. for 3 hours and further react at 8.3 kPa for 2 hours, to thereby produce crystalline polyester resin 5. The thus-produced crystalline polyester resin 5 was measured for X ray diffraction pattern (the result is shown in Table 1), melting point, dissolvability to an organic solvent, and molecular weight (the results are shown in Table 2).

Production Example 6

Synthesis of Crystalline Polyester Resin 6

A 5 L four-neck flask equipped with a nitrogen-introducing pipe, a drainpipe, a stirrer and a thermocouple was charged with 1,10-decanedioic acid (2,400 g), 1,6-hexanediol (1,330 g) and hydroquinone (4.9 g), followed by reaction at 200° C. for 10 hours. Thereafter, the reaction mixture was allowed to react at 220° C. for 3 hours and further react at 8.3 kPa for 2 hours, to thereby produce crystalline polyester resin 6. The thus-produced crystalline polyester resin 6 was measured for X ray diffraction pattern (the result is shown in Table 1), melting point, dissolvability to an organic solvent, and molecular weight (the results are shown in Table 2).

Production Example 7

Synthesis of Crystalline Polyester Resin 7

A 5 L four-neck flask equipped with a nitrogen-introducing pipe, a drainpipe, a stirrer and a thermocouple was charged with 1,10-decanedioic acid (2,400 g), 1,6-hexanediol (830 g), 1,4-butanediol (430 g) and hydroquinone (4.9 g), followed by reaction at 200° C. for 10 hours. Thereafter, the reaction mixture was allowed to react at 220° C. for 3 hours and further react at 8.3 kPa for 2 hours, to thereby produce crystalline polyester resin 7. The thus-produced crystalline polyester resin 7 was measured for X ray diffraction pattern (the result is shown in Table 1), melting point, dissolvability to an organic solvent, and molecular weight (the results are shown in Table 2).

Production Example 8

Synthesis of Crystalline Polyester Resin 8

A 5 L four-neck flask equipped with a nitrogen-introducing pipe, a drainpipe, a stirrer and a thermocouple was charged with 1,10-decanedioic acid (2,700 g), ethylene glycol (620 g) and hydroquinone (4.9 g), followed by reaction at 200° C. for 10 hours. Thereafter, the reaction mixture was allowed to react at 220° C. for 3 hours and further react at 8.3 kPa for 2 hours, to thereby produce crystalline polyester resin 8. The thus-produced crystalline polyester resin 8 was measured for X ray diffraction pattern (the result is shown in Table 1), melting point, dissolvability to an organic solvent, and molecular weight (the results are shown in Table 2).

Production Example 9

Synthesis of Crystalline Polyester Resin 9

A 5 L four-neck flask equipped with a nitrogen-introducing pipe, a drainpipe, a stirrer and a thermocouple was charged with 1,10-terephthalic acid (2,520 g), 1,6-hexanediol (2,880 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 9. The thus-produced crystalline polyester resin 9 was measured for X ray diffraction pattern (the result is shown in Table 1), melting point, dissolvability to an organic solvent, and molecular weight (the results are shown in Table 2).

Production Example 10

Synthesis of Crystalline Polyester Resin 10

A 5 L four-neck flask equipped with a nitrogen-introducing pipe, a drainpipe, a stirrer and a thermocouple was charged with fumaric acid (2,160 g), 1,6-octanediol (2,120 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 10. The thus-produced crystalline polyester resin 10 was measured for X ray diffraction pattern (the result is shown in Table 1), melting point, dissolvability to an organic solvent, and molecular weight (the results are shown in Table 2).

Production Example 11

Synthesis of Crystalline Polyester Resin 11

A 5 L four-neck flask equipped with a nitrogen-introducing pipe, a drainpipe, a stirrer and a thermocouple was charged with 1,10-octanoic acid (2,520 g), 1,8-pentanediol (2,880 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 11. The thus-produced crystalline polyester resin 11 was measured for X ray diffraction pattern (the result is shown in Table 1), melting point, dissolvability to an organic solvent, and molecular weight (the results are shown in Table 2).

Production Example 12

Synthesis of Crystalline Polyester Resin 12

A 5 L four-neck flask equipped with a nitrogen-introducing pipe, a drainpipe, a stirrer and a thermocouple was charged with 1,10-adipic acid (2,320 g), 1,8-hexanediol (2,580 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 12. The thus-produced crystalline polyester resin 12 was measured for X ray diffraction pattern (the result is shown in Table 1), melting point, dissolvability to an organic solvent, and molecular weight (the results are shown in Table 2).

Production Example 13

Synthesis of Crystalline Polyester Resin 13

A 5 L four-neck flask equipped with a nitrogen-introducing pipe, a drainpipe, a stirrer and a thermocouple was charged with fumaric acid (1,920 g), 1,6-hexanediol (2,480 g) and hydroquinone (4.9 g), followed by reaction at 180° C. for 10 hours. Thereafter, the reaction mixture was allowed to react at 200° C. for 3 hours and further react at 8.3 kPa for 2 hours, to thereby produce crystalline polyester resin 13. The thus-produced crystalline polyester resin 13 was measured for X ray diffraction pattern (the result is shown in Table 1), melting point, dissolvability to an organic solvent, and molecular weight (the results are shown in Table 2).

TABLE 1

| | P1 2θ [°] | Half width of P1 [°] | P2 2θ [°] | Half width of P2 [°] |
|---|---|---|---|---|
| Crystalline polyester 1 | 21.5 | 0.45 | 24.6 | 0.46 |
| Crystalline polyester 2 | 21.7 | 0.55 | 24.7 | 0.56 |
| Crystalline polyester 3 | 21.7 | 0.65 | 24.7 | 0.68 |
| Crystalline polyester 4 | 22.5 | 0.65 | 24.2 | 0.65 |
| Crystalline polyester 5 | 22 | 0.55 | 24.6 | 0.56 |
| Crystalline polyester 6 | 20.9 | 0.53 | 24.2 | 0.54 |
| Crystalline polyester 7 | 21.2 | 0.52 | 23.9 | 0.53 |
| Crystalline polyester 8 | 21.5 | 0.48 | 24.5 | 0.52 |
| Crystalline polyester 9 | 21.2 | 1.50 | 24.8 | 2.50 |
| Crystalline polyester 10 | 23.5 | 1.20 | — | — |
| Crystalline polyester 11 | 20.5 | 1.20 | 23 | 1.60 |
| Crystalline polyester 12 | 21.1 | 1.20 | 24.2 | 1.30 |
| Crystalline polyester 13 | 20.3 | 1.20 | 22.5 | 1.80 |

TABLE 2

| | Melting point | Dissolv-ability (70° C.) | Dissolv-ability (20° C.) | Mw | Mn | Mw/Mn |
|---|---|---|---|---|---|---|
| Crystalline polyester 1 | 70 | 20 | 1.5 | 15000 | 4000 | 3.8 |
| Crystalline polyester 2 | 70 | 20 | 2 | 12000 | 3000 | 4.0 |
| Crystalline polyester 3 | 70 | 20 | 3.1 | 13000 | 4500 | 2.9 |
| Crystalline polyester 4 | 70 | 9 | 0.5 | 20000 | 4000 | 5.0 |
| Crystalline polyester 5 | 73 | 20 | 1.1 | 15000 | 3500 | 4.3 |

TABLE 2-continued

| | Melting point | Dissolv-ability (70° C.) | Dissolv-ability (20° C.) | Mw | Mn | Mw/Mn |
|---|---|---|---|---|---|---|
| Crystalline polyester 6 | 66 | 20 | 2.1 | 12000 | 3300 | 3.6 |
| Crystalline polyester 7 | 62 | 20 | 3.3 | 11000 | 3000 | 3.7 |
| Crystalline polyester 8 | 78 | 20 | 0.5 | 18000 | 5000 | 3.6 |
| Crystalline polyester 9 | 70 | 20 | 2.8 | 13000 | 2500 | 5.2 |
| Crystalline polyester 10 | 85 | 20 | 1.5 | 12000 | 3000 | 4.0 |
| Crystalline polyester 11 | 78 | 20 | 2.2 | 13000 | 4500 | 2.9 |
| Crystalline polyester 12 | 62 | 20 | 2.5 | 11000 | 4000 | 2.8 |
| Crystalline polyester 13 | 100 | 20 | 0.8 | 10000 | 3000 | 3.3 |

Production Example 14

Preparation of Dispersion Liquid of Crystalline Polyester Resin

A 2 L metal container was charged with 100 g of [crystalline polyester resin 1] and 400 g of ethyl acetate, followed by heating at 75° C. for dissolution. Thereafter, the resultant mixture was quenched in an ince-water bath at a rate of 27° C./min. Then, glass beads (3 mm in diameter) (500 mL) were added to the mixture to perform pulverization with a batch-type sand mill (product of Kanpe Hapio Co., Ltd.) for 10 hours, to thereby produce [crystalline polyester dispersion liquid 1].

The same procedure as described above was repeated, except that [crystalline polyester resin 1] was changed to [crystalline polyester resin 2], to thereby produce [crystalline polyester dispersion liquid 2].

The same procedure as described above was repeated, except that [crystalline polyester resin 1] was changed to [crystalline polyester resin 3], to thereby produce [crystalline polyester dispersion liquid 3].

The same procedure as described above was repeated, except that [crystalline polyester resin 1] was changed to [crystalline polyester resin 4], to thereby produce [crystalline polyester dispersion liquid 4].

The same procedure as described above was repeated, except that [crystalline polyester resin 1] was changed to [crystalline polyester resin 5], to thereby produce [crystalline polyester dispersion liquid 5].

The same procedure as described above was repeated, except that [crystalline polyester resin 1] was changed to [crystalline polyester resin 6], to thereby produce [crystalline polyester dispersion liquid 6].

The same procedure as described above was repeated, except that [crystalline polyester resin 1] was changed to [crystalline polyester resin 7], to thereby produce [crystalline polyester dispersion liquid 7].

The same procedure as described above was repeated, except that [crystalline polyester resin 1] was changed to [crystalline polyester resin 8], to thereby produce [crystalline polyester dispersion liquid 8].

The same procedure as described above was repeated, except that [crystalline polyester resin 1] was changed to [crystalline polyester resin 9], to thereby produce [crystalline polyester dispersion liquid 9].

The same procedure as described above was repeated, except that [crystalline polyester resin 1] was changed to [crystalline polyester resin 10], to thereby produce [crystalline polyester dispersion liquid 10].

The same procedure as described above was repeated, except that [crystalline polyester resin 1] was changed to

[crystalline polyester resin 11], to thereby produce [crystalline polyester dispersion liquid 11].

The same procedure as described above was repeated, except that [crystalline polyester resin 1] was changed to [crystalline polyester resin 12], to thereby produce [crystalline polyester dispersion liquid 12].

The same procedure as described above was repeated, except that [crystalline polyester resin 1] was changed to [crystalline polyester resin 13], to thereby produce [crystalline polyester dispersion liquid 13].

Example 1

Production Example 15

Synthesis of Non-Crystalline Polyester (Low-Molecular-Weight Non-Crystalline Polyester) Resin A 5 L four-neck flask equipped with a nitrogen-introducing pipe, a drainpipe, a stirrer and a thermocouple was charged with bisphenol A ethylene oxide 2 mole adduct (229 parts), bisphenol A propylene oxide 3 mole adduct (529 parts), isophthalic acid (100 parts), terephthalic acid (108 parts), adipic acid (46 parts) and dibutyl tin oxide (2 parts). The reaction mixture was allowed to react under normal pressure at 230° C. for 10 hours and further react under a reduced pressure of 10 mmHg to 15 mmHg for 5 hours. Then, trimellitic anhydride (30 parts) was added to the reaction container, followed by reaction at 180° C. under normal pressure for 3 hours, to thereby produce [non-crystalline polyester 1]. The [non-crystalline polyester 1] was found to have a number average molecular weight of 1,800, a weight average molecular weight of 5,500, a Tg of 50° C. and an acid value of 20.

Production Example 16

Synthesis of Polyester Prepolymer (Binder Resin Precursor)

A reaction container equipped with a condenser, a stirrer and a nitrogen-introducing pipe was charged with bisphenol A ethylene oxide 2 mole adduct (682 parts), bisphenol A propylene oxide 2 mole adduct (81 parts), terephthalic acid (283 parts), trimellitic anhydride (22 parts) and dibutyl tin oxide (2 parts). The resultant mixture was allowed to react under normal pressure at 230° C. for 8 hours and further react at a reduced pressure of 10 mmHg to 15 mmHg for 5 hours, to thereby produce [intermediate polyester 1]. The [intermediate polyester 1] was found to have a number average molecular weight of 2,100, a weight average molecular weight of 9,500, a Tg of 55° C., an acid value of 0.5 and a hydroxyl value of 51.

Next, a reaction container equipped with a condenser, a stirrer and a nitrogen-introducing pipe was charged with 410 parts of [intermediate polyester 1], 89 parts of isophorone diisocyanate and 500 parts of ethyl acetate, followed by reaction at 100° C. for 5 hours, to thereby produce [prepolymer 1]. The amount of free isocyanate contained in [prepolymer 1] was found to be 1.53% by mass.

Production Example 17

Synthesis of Ketimine

A reaction container equipped with a stirring rod and a thermometer was charged with isophorone diisocyanate (170 parts) and methyl ethyl ketone (75 parts), followed by reaction at 50° C. for 5 hours, to thereby produce [ketimine compound 1]. The amine value of [ketimine compound 1] was found to be 418.

Production Example 18

Preparation of Masterbatch (MB)

Water (1,200 parts), carbon black (Printex35, product of Degussa) [DBP oil absorption amount=42 mL/100 mg, pH=9.5] (540 parts) and a polyester resin (1,200 parts) were mixed together with HENSCHEL MIXER (product of Mitsui Mining Co., Ltd). The resultant mixture was kneaded at 150° C. for 30 minutes with a two-roller mill, and then rolled, cooled and pulverized with a pulverizer, to thereby produce [masterbatch 1].

Production Example 19

Preparation of Oil Phase

A container equipped with a stirring rod and a thermometer was charged with [non-crystalline polyester 1] (378 parts), carnauba wax (110 parts), CCA (salycilic acid metal complex E-84: product of Orient Chemical Industries, Ltd.) (22 parts) and ethyl acetate (947 parts), and the mixture was heated to 80° C. under stirring. The resultant mixture was maintained at 80° C. for 5 hours and then cooled to 30° C. over 1 hour. Subsequently, [masterbatch 1] (500 parts) and ethyl acetate (500 parts) were charged into the reaction container, followed by mixing for 1 hour, to thereby prepare [raw material solution 1].

[Raw material solution 1] (1,324 parts) was placed in a container, and the carbon black and wax were dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, a 65% by mass ethyl acetate solution of [non-crystalline polyester 1] (1,042.3 parts) was added thereto, and passed once with the bead mill under the above conditions, to thereby obtain [pigment/wax dispersion liquid 1]. The solid content of [pigment/wax dispersion liquid 1] was found to be 50% by mass (130° C., 30 minutes).

Production Example 20

Preparation of Fine Organic Particle Emulsion

A reaction container equipped with a stirring rod and a thermometer was charged with water (683 parts), a sodium salt of sulfuric acid ester of methacrylic acid-ethylene oxide adduct (ELEMINOL RS-30: product of Sanyo Chemical Industries, Ltd.) (11 parts), styrene (138 parts), methacrylic acid (138 parts) and ammonium persulfate (1 part), and the resultant mixture was stirred at 400 rpm for 15 min to prepare a white emulsion. The thus-obtained emulsion was heated to 75° C. and allowed to react for 5 hours. Subsequently, a 1% by mass aqueous ammonium persulfate solution (30 parts) was added to the reaction mixture, followed by aging at 75° C. for 5 hours, to thereby prepare an aqueous dispersion liquid [fine particle dispersion liquid 1] of a vinyl resin (a copolymer of styrene/methacrylic acid/sodium salt of sulfuric acid ester of methacrylic acid ethylene oxide adduct). The thus-prepared [fine particle dispersion liquid 1] was measured for volume average particle diameter with a laser diffraction/scattering particle size analyzer LA-920 (product of Horiba, Ltd.), and was found to have a volume average particle diameter of 0.14 μm. Part of the [fine particle dispersion liquid 1] was dried to separate resin.

Production Example 21

Preparation of Aqueous Phase

Water (990 parts), [fine particle dispersion liquid 1] (83 parts), a 48.5% aqueous solution of sodium dodecyldiphenyl ether disulfonate (ELEMINOL MON-7, product of Sanyo Chemical Industries Ltd.) (37 parts) and ethyl acetate (90 parts) were mixed together and stirred to obtain an opaque white liquid, which was used as [aqueous phase 1].

Production Example 22

Emulsification/Desolvation

[Pigment/wax dispersion liquid 1] (664 parts), [prepolymer 1] (109.4 parts), [crystalline polyester dispersion liquid 1] (73.9 parts) and [ketimine compound 1] (4.6 parts) were placed in a container, followed by mixing for 1 minute at 5,000 rpm with a TK homomixer (product of Tokushu Kika Kogyo Co., Ltd.). Thereafter, [aqueous phase 1] (1,200 parts) was added to the container, and the resultant mixture was mixed with the TK homomixer at 13,000 rpm for 20 minutes, to thereby produce [emulsified slurry 1].

A container equipped with a stirrer and a thermometer was charged with [emulsified slurry 1], followed by desolvation at 30° C. for 8 hours and aging at 45° C. for 4 hours, to thereby produce [dispersion slurry 1].

Production Example 23

Washing/Drying

[Dispersion slurry 1] (100 parts) was filtrated under reduced pressure and then subjected twice to a series of treatments (1) to (4) described below, to thereby produce [filtration cake 1]:

(1): ion-exchanged water (100 parts) was added to the filtration cake, followed by mixing with a TK homomixer (at 12,000 rpm for 10 minutes) and then filtration;

(2): 10% aqueous sodium hydroxide solution (100 parts) was added to the filtration cake obtained in (1), followed by mixing with a TK homomixer (at 12,000 rpm for 30 minutes) and then filtration under reduced pressure;

(3): 10% by mass hydrochloric acid (100 parts) was added to the filtration cake obtained in (2), followed by mixing with a TK homomixer (at 12,000 rpm for 10 minutes) and then filtration; and (4): ion-exchanged water (300 parts) was added to the filtration cake obtained in (3), followed by mixing with a TK homomixer (at 12,000 rpm for 10 minutes) and then filtration.

[Filtration cake 1] was dried with an air-circulating drier at 45° C. for 48 hours, and then was caused to pass through a sieve with a mesh size of 75 μm, to thereby prepare [toner 1].

Example 2

The procedure of Example 1 was repeated, except that [crystalline polyester dispersion liquid 1] was changed to [crystalline polyester dispersion liquid 2] in the process of "Emulsification/Desolvation," to thereby produce [toner 2].

Example 3

The procedure of Example 1 was repeated, except that [crystalline polyester dispersion liquid 1] was changed to [crystalline polyester dispersion liquid 3] in the process of "Emulsification/Desolvation," to thereby produce [toner 3].

Example 4

The procedure of Example 1 was repeated, except that [crystalline polyester dispersion liquid 1] was changed to [crystalline polyester dispersion liquid 4] in the process of "Emulsification/Desolvation," to thereby produce [toner 4].

Example 5

The procedure of Example 1 was repeated, except that [crystalline polyester dispersion liquid 1] was changed to [crystalline polyester dispersion liquid 5] in the process of "Emulsification/Desolvation," to thereby produce [toner 5].

Example 6

The procedure of Example 1 was repeated, except that [crystalline polyester dispersion liquid 1] was changed to [crystalline polyester dispersion liquid 6] in the process of "Emulsification/Desolvation," to thereby produce [toner 6].

Example 7

The procedure of Example 1 was repeated, except that [crystalline polyester dispersion liquid 1] was changed to [crystalline polyester dispersion liquid 7] in the process of "Emulsification/Desolvation," to thereby produce [toner 7].

Example 8

The procedure of Example 1 was repeated, except that [crystalline polyester dispersion liquid 1] was changed to [crystalline polyester dispersion liquid 8] in the process of "Emulsification/Desolvation," to thereby produce [toner 8].

Comparative Example 1

The procedure of Example 1 was repeated, except that [crystalline polyester dispersion liquid 1] was changed to [crystalline polyester dispersion liquid 9] in the process of "Emulsification/Desolvation," to thereby produce [toner 9].

Comparative Example 2

The procedure of Example 1 was repeated, except that [crystalline polyester dispersion liquid 1] was changed to [crystalline polyester dispersion liquid 10] in the process of "Emulsification/Desolvation," to thereby produce [toner 10].

Comparative Example 3

The procedure of Example 1 was repeated, except that [crystalline polyester dispersion liquid 1] was not used in the process of "Emulsification/Desolvation," to thereby produce [toner 11].

Comparative Example 4

The procedure of Example 1 was repeated, except that [crystalline polyester dispersion liquid 1] was changed to

[crystalline polyester dispersion liquid 11] in the process of "Emulsification/Desolvation," to thereby produce [toner 12].

Comparative Example 5

The procedure of Example 1 was repeated, except that [crystalline polyester dispersion liquid 1] was changed to [crystalline polyester dispersion liquid 12] in the process of "Emulsification/Desolvation," to thereby produce [toner 13].

Comparative Example 6

The procedure of Example 1 was repeated, except that [crystalline polyester dispersion liquid 1] was changed to [crystalline polyester dispersion liquid 13] in the process of "Emulsification/Desolvation," to thereby produce [toner 14].

Each (100 parts) of the thus-produced toners was mixed in a HENSCHEL MIXER with hydrophobic silica (0.7 parts) and hydrophobic titanium oxide (0.3 parts).

Extraction of Crystalline Polyester Component from Toner

Example 9

First, 1 g of [toner 1] obtained in Example 1 was added to 100 mL of THF. Subsequently, the resultant mixture was stirred at 25° C. for 30 minutes to prepare a solution containing soluble matter of [toner 1].

The thus-prepared solution was filtrated with a membrane filter having a pore size of 0.2 μm, to thereby obtain a toner solution.

The toner solution was used as a sample for GPC. An apparatus used for GPC was "HLC-8120GPC, SC-8020 (product of TOSOH CORPORATION)," a column used was two columns of "TSKgel, SuperHM-H (product of TOSOH CORPORATION (6.0 mmID×15 cm)" and an eluant used was THF (tetrahydrofuran).

The experimental conditions were as follows: sample concentration: 0.5% by mass, flow rate: 0.6 mL/min, sample amount injected: 10 μL and measurement temperature: 40° C. The detection was performed with an IR detector.

Also, a calibration curve was obtained using "polystylene standard sample TSK standard" (product of TOSOH CORPORATION) of the following 10 samples: "A-500," "F-1," "F-10," "F-80," "F-380," "A-2500," "F-4," "F-40," "F-128" and "F-700."

Notably, in this analysis, the data were collected every 300 ms.

Meanwhile, a fraction collector was disposed at the outlet of an eluate obtained through GPC, and eluates were recovered at predetermined counts. Every 5% of the area ratio from initiation (rising of the curve) in the elution curve W1, the eluates were combined together. The THF was evaporated off from the thus-combined eluates to obtain eluates for each fraction.

Next, each (30 mg) of the eluates was dissolved in 1 mL of deuterated chloroform. In addition, tetramethylsilane (TMS) serving as a reference substance was added thereto at a concentration of 0.05% by volume.

The resultant solution was charged into a glass tube for NMR (diameter: 5 mm), and then integrated 128 times at 23° C. to 25° C. using a nuclear magnetic resonance apparatus (JNM-AL400, product of JEOL Ltd.), to thereby obtain a spectrum.

The composition or ratio of the monomers of the resins contained can be determined on the basis of the integral ratio of the peaks in the obtained spectrum.

Specifically, the compositional ratio of the constituent monomers was determined from respective integral ratios on the basis of attribution of each peak as follows.

The attribution of the peaks was, for example, as follows: 8.25 ppm and thereabout: attributed to the benzene ring of trimellitic acid (corresponding to one hydrogen atom), 8.07 ppm to 8.10 ppm and thereabout: attributed to the benzene ring of terephthalic acid (corresponding to four hydrogen atoms), 7.1 ppm to 7.25 ppm and thereabout: attributed to the benzene ring of bisphenol A (corresponding to four hydrogen atoms), 6.8 ppm and thereabout: attributed to the benzene ring of bisphenol A (corresponding to four hydrogen atoms) and the double bond of fumaric acid (corresponding to two hydrogen atom), 5.2 ppm to 5.4 ppm and thereabout: attributed to the methine of bisphenol A propylene oxide adduct (corresponding to one hydrogen atom) and the double bond of alkenylsuccinic acid (corresponding to two hydrogen atoms), 3.7 ppm to 4.7 ppm and thereabout: attributed to the methylene of bisphenol A propylene oxide adduct (corresponding to two hydrogen atoms) and the methylene of bisphenol A ethylene oxide adduct (corresponding to four hydrogen atoms), 1.6 ppm and thereabout: attributed to the methyl group of bisphenol A (corresponding to six hydrogen atoms) and 0.8 ppm to 0.9 ppm and thereabout: attributed to the terminal methyl group of alkenylsuccinic acid (corresponding to 12 hydrogen atoms).

From the obtained results, a fraction mainly containing the crystalline polyester was identified.

The eluate mainly containing the crystalline polyester was subjected to X-ray diffraction analysis under the above-described conditions, to thereby obtain a diffraction peak of the crystalline polyester. The results are shown in Table 3.

As shown in Table 3, crystalline polyester resin 1 having been extracted from toner 1 in the above-described manner was found to show similar X-ray diffraction data to those of crystalline polyester 1 shown in Table 1; i.e., P1, half width of P1, P2 and half width of P2 were similar therebetween. Also in the below-described Examples 10 to 16 and Comparative Examples 7 to 12, the crystalline polyester resin extracted from each toner was found to show similar X-ray diffraction data to those of the crystalline polyester only to be contained in the toner.

In conclusion, in the present invention, X-ray diffraction of the crystalline polyester resin contained in the toner as the binder resin component may be conducted on the crystalline polyester resin serving as a raw material or the crystalline polyester resin having been extracted from the toner.

Example 10

The procedure of Example 9 was repeated, except that the toner used in Example 9 was changed from [toner 1] to [toner 2], to thereby perform "Extraction of crystalline polyester from toner" and X-ray measurement. The results are shown in Table 3.

Example 11

The procedure of Example 9 was repeated, except that the toner used in Example 9 was changed from [toner 1] to [toner 3], to thereby perform "Extraction of crystalline polyester from toner" and X-ray measurement. The results are shown in Table 3.

Example 12

The procedure of Example 9 was repeated, except that the toner used in Example 9 was changed from [toner 1] to [toner 4], to thereby perform "Extraction of crystalline polyester from toner" and X-ray measurement. The results are shown in Table 3.

Example 13

The procedure of Example 9 was repeated, except that the toner used in Example 9 was changed from [toner 1] to [toner 5], to thereby perform "Extraction of crystalline polyester from toner" and X-ray measurement. The results are shown in Table 3.

Example 14

The procedure of Example 9 was repeated, except that the toner used in Example 9 was changed from [toner 1] to [toner 6], to thereby perform "Extraction of crystalline polyester from toner" and X-ray measurement. The results are shown in Table 3.

Example 15

The procedure of Example 9 was repeated, except that the toner used in Example 9 was changed from [toner 1] to [toner 7], to thereby perform "Extraction of crystalline polyester from toner" and X-ray measurement. The results are shown in Table 3.

Example 16

The procedure of Example 9 was repeated, except that the toner used in Example 9 was changed from [toner 1] to [toner 8], to thereby perform "Extraction of crystalline polyester from toner" and X-ray measurement. The results are shown in Table 3.

Comparative Example 7

The procedure of Example 9 was repeated, except that the toner used in Example 9 was changed from [toner 1] to [toner 9], to thereby perform "Extraction of crystalline polyester from toner" and X-ray measurement. The results are shown in Table 3.

Comparative Example 8

The procedure of Example 9 was repeated, except that the toner used in Example 9 was changed from [toner 1] to [toner 10], to thereby perform "Extraction of crystalline polyester from toner" and X-ray measurement. The results are shown in Table 3.

Comparative Example 9

The procedure of Example 9 was repeated, except that the toner used in Example 9 was changed from [toner 1] to [toner 11], to thereby perform "Extraction of crystalline polyester from toner" and X-ray measurement. Since [toner 11] contains no crystalline polyester, clear diffraction peaks could not be observed. The results are shown in Table 3.

Comparative Example 10

The procedure of Example 9 was repeated, except that the toner used in Example 9 was changed from [toner 1] to [toner 12], to thereby perform "Extraction of crystalline polyester from toner" and X-ray measurement. The results are shown in Table 3.

Comparative Example 11

The procedure of Example 9 was repeated, except that the toner used in Example 9 was changed from [toner 1] to [toner 13], to thereby perform "Extraction of crystalline polyester from toner" and X-ray measurement. The results are shown in Table 3.

Comparative Example 12

The procedure of Example 9 was repeated, except that the toner used in Example 9 was changed from [toner 1] to [toner 14], to thereby perform "Extraction of crystalline polyester from toner" and X-ray measurement. The results are shown in Table 3.

TABLE 3

| | Toner | P1 2θ [°] | Half width of P1 [°] | P2 2θ [°] | Half width of P2 [°] |
|---|---|---|---|---|---|
| Ex. 9 | Toner 1 | 21.6 | 0.48 | 24.5 | 0.49 |
| Ex. 10 | Toner 2 | 21.8 | 0.56 | 24.6 | 0.57 |
| Ex. 11 | Toner 3 | 21.5 | 0.66 | 24.6 | 0.69 |
| Ex. 12 | Toner 4 | 22.6 | 0.68 | 24.3 | 0.67 |
| Ex. 13 | Toner 5 | 22.1 | 0.56 | 24.6 | 0.57 |
| Ex. 14 | Toner 6 | 20.8 | 0.55 | 24.1 | 0.56 |
| Ex. 15 | Toner 7 | 21.3 | 0.53 | 24.1 | 0.55 |
| Ex. 16 | Toner 8 | 21.4 | 0.49 | 24.4 | 0.53 |
| Comp. Ex. 7 | Toner 9 | 21.4 | 1.53 | 24.3 | 2.54 |
| Comp. Ex. 8 | Toner 10 | 23.3 | 1.23 | — | — |
| Comp. Ex. 9 | Toner 11 | — | — | — | — |
| Comp. Ex. 10 | Toner 12 | 20.4 | 1.23 | 23.1 | 1.62 |
| Comp. Ex. 11 | Toner 13 | 21.1 | 1.21 | 24.3 | 1.32 |
| Comp. Ex. 12 | Toner 14 | 20.3 | 1.21 | 22.4 | 1.83 |

Next, each (5% by mass) of the above-obtained toner having undergone treatment using external additives was mixed with silicone resin-coated copper-zinc ferrite carriers (volume average particle diameter: 40 μm) (95% by mass) to prepare a developer. The thus-prepared developer was evaluated for fixing ability, heat resistant storage stability, image graininess, image sharpness, filming and fogging according to the following evaluation methods. The evaluation results are shown in Tables 4-1 and 4-2. Also, the glass transition temperatures (i.e., Tg1st and Tg2nd) are shown together with the evaluation results in Table 4-1.

(Fixing Ability)

The fixing portion of the copier MF-2200 (product of Ricoh Company, Ltd.) employing a TEFLON (registered trade mark) roller as a fixing roller was modified to produce a modified copier. The above-produced developer and Type 6200 paper sheets (product of Ricoh Company, Ltd.) were set in the modified copier for printing test.

Specifically, the cold offset temperature (minimum fixing temperature) and the hot offset temperature (maximum fixing temperature) were determined while changing the fixing temperature.

The evaluation conditions for the minimum fixing temperature were set as follows: linear velocity of paper feeding: 120 mm/sec to 150 mm/sec, surface pressure: 1.2 kgf/cm$^2$ and nip width: 3 mm.

The evaluation conditions for the maximum fixing temperature were set as follows: linear velocity of paper feeding: 50 mm/sec, surface pressure: 2.0 kgf/cm$^2$ and nip width: 4.5 mm.

<Evaluation Criteria for Fixing Ability>

(Ranks of Minimum Fixing Temperature)

A: Excellent low-temperature fixing ability, contributing greatly to improvement in energy saving performance.

B: Good low-temperature fixing ability, involving no practical problems.

C: Poor low-temperature fixing ability, involving practical problems.

D: Poor low-temperature fixing ability, involving great practical problems.

(Ranks of Maximum Fixing Temperature)

A: Excellent fixing offset property, involving no problems when used for various types of paper at various temperatures.

B: Good fixing offset property, involving almost no problems when used for various types of paper at various temperatures.

C: Poor fixing offset property, involving practical problems.

D: Bad fixing offset property, involving great practical problems.

(Heat Resistant Storage Stability)

The toner was stored at 50° C. for 8 hours, and then sieved with a 42-mesh sieve for 2 min. The amount of the toner remaining on the mesh was measured relative to the total amount of the toner (residual toner rate).

Here, the better the heat resistant storage stability of the toner, the lower the residual toner rate.

Notably, the heat resistant storage stability was evaluated according to the following criteria.

A: Residual toner rate <10%

B: 10%≤Residual toner rate <20%

C: 20%≤Residual toner rate <30%

D: 30%≤Residual toner rate (Image Graininess and Sharpness)

Using a digital full color copier (IMAGIOCOLOR2800, product of Ricoh Company, Ltd.), 30,000 sheet-running test of a photo was performed in the monochromatic mode. Thereafter, the obtained image was visually evaluated for graininess and sharpness according to the following criteria.

A: Comparable to offset printing

B: Slightly poorer than offset printing

C: Considerably poorer than offset printing

D: Comparable to a conventional electrophotographic image (very bad)

(Filming)

Printing of 10,000 images was performed using the image forming apparatus MF2800 (product of Ricoh Company, Ltd.), and then the photoconductor was visually observed and evaluated for adhesion of toner components, particularly the releasing agent, onto the photoconductor.

The evaluation was based on the following criteria.

A: No adhesion of toner component onto photoconductor was observed

B: Adhesion of toner component onto photoconductor was observed to such an extent that it did not involve problems in practical use C: Adhesion of toner component onto photoconductor was observed to such an extent that it involved problems in practical use D: Adhesion of toner component onto photoconductor was observed to such an extent that it involved great problems in practical use (Fogging)

Using the tandem-type color electrophotographic apparatus IMAGIO NEO 450 (product of Ricoh Company, Ltd.) having a cleaning blade and a charging roller each being provided so as to be in contact with a photoconductor, 10,000 copies of a laterally-set A4 chart (image pattern A) having a pattern formed by alternatingly repeating a 1 cm black solid portion and 1 cm white solid portion in a direction perpendicular to the rotating direction of the developing sleeve were printed out. Thereafter, a blank image was printed out, and the printed image was visually evaluated for fogging according to the following criteria.

<Evaluation Criteria>

A: No fogging was observed

B: Fogging was observed to such an extent that it involved no problems in practical use C: Fogging was observed to such an extent that it could involve problems in practical use D: Fogging was observed to such an extent that it involved great problems in practical use The evaluation results of Examples 1 to 8 and Comparative Examples 1 to 6 are shown in Tables 4-1 and 4-2 given below.

TABLE 4-1

| | Tg1st | Tg2nd | Minimum fixing temp. (° C./Rank) | | Maximum fixing temp. (° C./Rank) | |
|---|---|---|---|---|---|---|
| Ex. 1 | 59 | 31 | 120 | A | 190 | A |
| Ex. 2 | 57 | 30 | 120 | A | 185 | B |
| Ex. 3 | 60 | 34 | 120 | A | 180 | B |
| Ex. 4 | 56 | 32 | 125 | B | 190 | A |
| Ex. 5 | 60 | 33 | 120 | A | 190 | A |
| Ex. 6 | 57 | 30 | 120 | A | 185 | B |
| Ex. 7 | 55 | 30 | 120 | A | 180 | B |
| Ex. 8 | 60 | 35 | 125 | B | 190 | A |
| Comp. Ex. 1 | 55 | 45 | 135 | C | 190 | A |
| Comp. Ex. 2 | 58 | 45 | 140 | D | 190 | A |
| Comp. Ex. 3 | 58 | 52 | 145 | D | 190 | A |
| Comp. Ex. 4 | 56 | 46 | 135 | C | 190 | A |
| Comp. Ex. 5 | 52 | 44 | 135 | C | 190 | A |
| Comp. Ex. 6 | 58 | 50 | 140 | D | 190 | A |

TABLE 4-2

| | Heat resistant storage stability | Image quality | Filming | Fogging |
|---|---|---|---|---|
| Ex. 1 | A | A | A | A |
| Ex. 2 | A | A | A | A |
| Ex. 3 | B | B | A | A |
| Ex. 4 | B | B | B | B |
| Ex. 5 | A | A | A | A |
| Ex. 6 | A | A | B | A |
| Ex. 7 | B | A | B | A |
| Ex. 8 | A | A | A | A |
| Comp. Ex. 1 | D | D | D | D |
| Comp. Ex. 2 | C | D | D | D |
| Comp. Ex. 3 | A | A | A | A |
| Comp. Ex. 4 | C | C | D | D |
| Comp. Ex. 5 | D | D | D | D |
| Comp. Ex. 6 | B | C | D | D |

As is clear from the above tables, the toners in Examples 1 to 8 were found to be excellent in low-temperature fixing ability and heat resistant storage stability. Meanwhile, the toners in Comparative Examples 1, 2, 4, 5 and 6 were found to be poor in low-temperature fixing ability, heat resistant storage stability and image quality, since the crystalline polyester resin contained therein had low crystallinity.

The toner in Comparative Example 3 was found to be greatly poor in low-temperature fixing ability, since it contained no crystalline polyester resin.

What is claimed is:

1. A toner comprising:

a binder resin which contains a crystalline polyester resin and a non-crystalline polyester resin, and an amine elongation composition of polyester modified with an isocyanate, wherein the crystalline polyester resin is obtained by synthesizing with:

at least one alcohol component selected from the group consisting of ethylene glycol, 1,4-butanediol, 1,6-hexanediol, 1,8-octanediol, 1,10-decanediol, and 1,12-dodecanediol, and at least one dicarboxylic acid component selected from the group consisting of 1,10-decanediacid and 1,12-dodecanediacid;

wherein the crystalline polyester resin has at least two diffraction peaks in a range of $20° < 2\theta < 25°$ as detected by X-ray diffraction measurement, and has a melting point which is 60° C. or higher but lower than 80° C.; and wherein the diffraction peaks each have a half width which is less than 1.0°.

2. The toner according to claim 1, wherein the diffraction peaks each have a half width which is less than 0.6°.

3. The toner according to claim 1, wherein the crystalline polyester resin has a melting point which is 65° C. or higher but lower than 75° C.

4. The toner according to claim 1, wherein the toner has a glass transition temperature Tg1st which is 45° C. or higher but lower than 65° C., where the glass transition temperature Tg1st is measured at the first temperature raising in DSC.

5. The toner according to claim 1, wherein the toner has a glass transition temperature Tg2nd which is 20° C. or higher but lower than 40° C., where the glass transition temperature Tg2nd is measured at the second temperature raising in DSC.

6. The toner according to claim 1, wherein soluble matter of the crystalline polyester resin in orthodichlorobenzene has a weight average molecular weight Mw of 3,000 to 30,000, a number average molecular weight Mn of 1,000 to 10,000, and a Mw/Mn of 1 to 10, as measured through GPC.

7. The toner according to claim 6, wherein the soluble matter of the crystalline polyester resin in the orthodichlorobenzene has the weight average molecular weight Mw of 5,000 to 15,000, the number average molecular weight Mn of 2,000 to 10,000, and the Mw/Mn of 1 to 5, as measured through GPC.

8. The toner according to claim 1, wherein the toner is obtained by dispersing, in an aqueous medium, an oil phase containing an organic solvent and the binder resin in the organic solvent, so as to prepare a dispersion liquid, and by removing the organic solvent from the dispersion liquid.

9. The toner according to claim 8, wherein the crystalline polyester resin has a dissolvability to the organic solvent at 20° C. which is less than 3.0 parts by mass.

10. The toner according to claim 8, wherein the crystalline polyester resin has a dissolvability to the organic solvent at 70° C. which is equal to or more than 10.0 parts by mass.

11. The toner according to claim 8, wherein the binder resin comprises the amine elongation composition, the oil phase comprises a colorant and a releasing agent, and the aqueous medium comprises a dispersing agent, and wherein the toner is obtained by dissolving, in the oil phase, a compound capable of being elongated with the amine elongation composition; dispersing the oil phase in the aqueous medium to prepare the dispersion liquid; allowing the amine elongation composition to undergo an elongation reaction with the compound in the dispersion liquid; and removing the organic solvent from the dispersion liquid.

12. A developer comprising:

a toner, wherein the toner comprises a binder resin which contains a crystalline polyester resin and a non-crystalline polyester resin, wherein the toner further comprises an amine elongation composition of polyester modified with an isocyanate, wherein the crystalline polyester resin is obtained by synthesizing with:

at least one alcohol component selected from the group consisting of ethylene glycol, 1,4-butanediol, 1,6-hexanediol, 1,8-octanediol, 1,10-decanediol, and 1,12-dodecanediol, and at least one dicarboxylic acid component selected from the group consisting of 1,10-decanediacid and 1,12-dodecanediacid;

wherein the crystalline polyester resin has at least two diffraction peaks in a range of $20° < 2\theta < 25°$ as detected by X-ray diffraction measurement, and has a melting point which is 60° C. or higher but lower than 80° C.; and wherein the diffraction peaks each have a half width which is less than 1.0°.

13. The toner of claim 1, wherein the amine elongation composition has an average of from 1.5 to 3 isocyanate groups per molecule of polyester prepolymer.

14. The toner of claim 1, wherein the amine elongation composition has a weight average molecular weight of from $5\times10^3$ to $5\times10^4$.

15. The toner of claim 1, having a minimum fixing temperature of 125° C. or less.

16. The toner of claim 15, having a residual toner rate of less than 20% when stored at 50° C. for 8 h then sieved with a 42-mesh sieve for 2 min.

17. The toner of claim 15, wherein a release range of the toner is 60° C. or greater.

* * * * *